US011098940B2

(12) United States Patent
Finell

(10) Patent No.: US 11,098,940 B2
(45) Date of Patent: Aug. 24, 2021

(54) FLEXIBLE CONTAINER WITH ICE TRAY

(71) Applicant: ZIP TOP, LLC, Austin, TX (US)

(72) Inventor: Rebecca Finell, Austin, TX (US)

(73) Assignee: ZIP TOP LLC, Austin, TX (US)

( * ) Notice: Subject to any disclaimer, the term of this patent is extended or adjusted under 35 U.S.C. 154(b) by 0 days.

(21) Appl. No.: 16/296,416

(22) Filed: Mar. 8, 2019

(65) Prior Publication Data

US 2020/0284489 A1 Sep. 10, 2020

(51) Int. Cl.
*F25C 1/243* (2018.01)

(52) U.S. Cl.
CPC ..... *F25C 1/243* (2013.01)

(58) Field of Classification Search
CPC ..... F25C 1/243; F25C 1/246; B65D 81/3261; B65D 33/2541; B65D 75/323; B65D 75/324
See application file for complete search history.

(56) References Cited

U.S. PATENT DOCUMENTS 1,769,186 A * 7/1930 Morris ..... A61F 7/08 607/110
1,879,602 A * 9/1932 Copeman ..... F25C 1/24 249/130
2,012,113 A 8/1935 Thompson ..... 215/363
2,048,412 A * 7/1936 Sissman ..... F25C 1/246 249/130
2,117,738 A 5/1938 Otto ..... 220/266
2,165,277 A 7/1939 Herman ..... 229/405
2,542,294 A * 2/1951 Smith ..... A61F 7/103 383/40
2,563,933 A * 8/1951 Hipps ..... A61F 7/103 383/86
2,589,967 A 3/1952 Sawyer ..... 215/372
(Continued)

FOREIGN PATENT DOCUMENTS

CN 101312889 A 11/2008 ..... A44B 19/16
EP 0616948 A1 9/1994 ..... B65D 1/00
(Continued)

OTHER PUBLICATIONS

Partial European Search Report, Application No. 18159842.6, 9 pages, dated Jun. 29, 2018.
(Continued)

*Primary Examiner* — Xiao S Zhao
*Assistant Examiner* — Emmanuel S Luk
(74) *Attorney, Agent, or Firm* — Slayden Grubert Beard PLLC

(57) ABSTRACT

An ice-making container having a base and a freestanding side extending from the base to define a mouth opposite the base, and having a divider extending from the base and/or freestanding side so as to divide the container into at least two ice-making compartments. The container is a closable container via zipper members extending from the interior sides of the mouth, wherein the mouth is deformable between open and closed configurations and the first and second zipper members are disengagable when the mouth is open and engagable when the mouth is closed. The container may be molded from platinum silicone as a unitary whole without assembled parts. The molding process may comprise liquid injection molding, compression molding, or transfer molding.

17 Claims, 20 Drawing Sheets

(56) References Cited

U.S. PATENT DOCUMENTS 2,595,328 A * 5/1952 Bowen ..... A61F 7/02 607/114
2,800,269 A * 7/1957 Smith ..... B65D 31/145 383/38
2,861,716 A 11/1958 Kramer ..... 215/228
2,961,850 A * 11/1960 Tupper ..... F25C 1/243 249/126
2,966,041 A * 12/1960 Zearfoss, Jr. ..... F25D 25/00 62/60
3,052,399 A * 9/1962 Brown ..... B65D 77/14 383/204
3,306,567 A 2/1967 Frei, Sr. ..... 249/53 R
3,354,601 A 11/1967 Schneider ..... 493/196
3,799,914 A 3/1974 Schmit et al. ..... 426/85
3,804,077 A * 4/1974 Williams ..... A61F 7/03 126/263.1
3,844,525 A 10/1974 Parmett ..... 249/127
3,885,403 A * 5/1975 Spencer ..... A61F 7/02 62/530
3,893,834 A * 7/1975 Armstrong ..... A61F 7/106 62/4
4,055,188 A * 10/1977 Pelton ..... A61F 7/02 607/112
4,527,566 A * 7/1985 Abare ..... A61F 7/02 601/15
4,530,220 A * 7/1985 Nambu ..... A61F 7/10 607/114
4,587,810 A * 5/1986 Fletcher ..... F25B 21/02 249/130
D285,515 S 9/1986 Papciak ..... D24/119
4,655,862 A 4/1987 Christoff et al. ..... 156/66
4,676,247 A * 6/1987 Van Cleve ..... A61F 7/02 607/112
D291,659 S 9/1987 Powell ..... D7/507
4,783,042 A * 11/1988 Folkmar ..... B65D 33/1666 249/127
4,813,646 A * 3/1989 Fujio ..... A23G 9/221 249/127
4,883,251 A * 11/1989 Manas ..... F25C 1/24 249/53 R
5,046,860 A * 9/1991 Brennan ..... A45C 3/04 150/111
5,148,804 A * 9/1992 Hill ..... A61F 7/10 607/108
5,215,080 A * 6/1993 Thomas ..... A61F 7/10 607/112
5,237,838 A * 8/1993 Merritt-Munson .. A45C 11/008 383/110
5,350,045 A * 9/1994 Robertson ..... A45C 13/02 150/111
5,499,763 A 3/1996 Demars ..... 229/114
D374,204 S 10/1996 Weder ..... D11/143
5,689,866 A 11/1997 Kasai et al. ..... 24/585.12
5,692,837 A * 12/1997 Beer ..... B65D 33/25 383/120
5,758,473 A 6/1998 Patelli ..... 53/412
5,782,562 A * 7/1998 Anspacher ..... B65D 33/08 383/15
D399,708 S * 10/1998 Grissom ..... D7/629
D401,141 S 11/1998 Carroll et al. ..... D09/608
D407,970 S 4/1999 Planchard ..... D9/703
5,906,438 A * 5/1999 Laudenberg ..... B65D 33/2541 383/63
D418,368 S 1/2000 Solland ..... D7/510
D418,747 S 1/2000 Sagel ..... D9/707
D419,867 S 2/2000 Hager et al. ..... D09/608
6,050,432 A 4/2000 Koehnke ..... 215/11.3
D423,877 S 5/2000 Kerr ..... D07/509
6,076,967 A * 6/2000 Beaudette ..... B65D 33/2508 383/104
6,164,488 A 12/2000 Solland ..... 220/717
6,164,822 A * 12/2000 Beer ..... B65D 31/12 222/145.1
6,164,826 A * 12/2000 Petkovsek ..... B65D 31/10 383/120
6,176,420 B1 1/2001 Sarson ..... 229/128
6,197,359 B1 3/2001 Llorente Hompanera ... 426/523
6,245,367 B1 6/2001 Galomb ..... 426/115
D445,223 S * 7/2001 Butler ..... A01K 13/008 D30/135
6,325,543 B1 * 12/2001 Ausnit ..... B65D 33/2533 383/210.1
D456,211 S 4/2002 Price ..... D7/509
D457,318 S 5/2002 Borland et al. ..... D03/303
D464,258 S 10/2002 Edwards ..... D09/708
6,470,705 B2 * 10/2002 Bride-Flynn ..... A61F 7/103 607/108
D470,361 S 2/2003 Trombly ..... D7/509
D470,755 S 2/2003 Espinel ..... D9/707
D482,614 S 11/2003 Countee, Jr. ..... D09/430
D495,209 S 8/2004 Tranfaglia ..... D7/509
D502,364 S 3/2005 Chan ..... D7/509
6,945,988 B1 * 9/2005 Jones ..... A61F 7/10 607/108
7,029,178 B2 4/2006 Gzybowski ..... 383/64
D522,183 S 5/2006 Wylie ..... D30/118
7,065,983 B2 * 6/2006 Trinh ..... A61F 7/103 607/112
7,160,029 B2 1/2007 Bein et al. ..... 383/67
D541,171 S 4/2007 Delmotte et al. ..... D09/709
7,197,893 B2 * 4/2007 Trinh ..... A61F 7/103 62/457.2
7,204,641 B2 * 4/2007 Stolmeier ..... B65D 31/10 383/120
D553,442 S 10/2007 Bodum ..... D7/509
D554,432 S 11/2007 Roth et al. ..... D07/516
D567,592 S 4/2008 Fite, IV et al. ..... D07/568
D580,779 S 11/2008 Hartwell et al. ..... D09/705
D582,790 S 12/2008 Friebe ..... D9/707
D586,232 S 2/2009 Friebe ..... D9/707
7,524,111 B1 4/2009 Williams ..... 220/23.87
D600,072 S 9/2009 Hayes ..... D7/509
D605,895 S 12/2009 Abbott ..... D7/509
D609,581 S 2/2010 Doyal ..... D09/703
D616,760 S 6/2010 Deuerer ..... D09/611
D618,302 S 6/2010 Williams ..... D23/209
D622,109 S 8/2010 Hull et al. ..... D7/630
D627,608 S * 11/2010 Markum ..... D7/672
1,002,346 A1 9/2011 Weeks ..... 229/400
8,070,359 B2 * 12/2011 Taheri ..... B29C 48/87 383/66
D657,950 S 4/2012 Herman ..... D3/202
D660,446 S 5/2012 Baltazar ..... D24/208
8,182,407 B2 * 5/2012 Yeager ..... B31B 50/81 493/213
8,209,995 B2 * 7/2012 Kieling ..... A45C 3/001 62/457.1
8,220,651 B2 7/2012 Norcom ..... 220/1.6
D668,118 S 10/2012 Hayes et al. ..... D07/602
D672,202 S 12/2012 Craft et al. ..... D07/586
D683,190 S 5/2013 Shields ..... D07/544
D683,592 S 6/2013 Shields ..... D07/544
D684,867 S 6/2013 English ..... D9/707
D684,868 S 6/2013 Kessler ..... D9/707
D686,508 S 7/2013 Kling ..... D9/703
8,479,972 B2 7/2013 Craft et al. ..... 229/101
D689,370 S 9/2013 Bower ..... D9/707
8,523,440 B2 9/2013 Walker et al. ..... 383/202
D690,995 S 10/2013 Franco ..... D07/516
8,690,428 B2 * 4/2014 Kruse ..... B65D 33/2591 383/5
8,696,727 B2 * 4/2014 Emon ..... A61F 7/10 607/114
D705,654 S 5/2014 Wurth et al. ..... D09/451
8,864,015 B2 10/2014 Lu ..... 229/128
D722,805 S 2/2015 Banos ..... D07/301
D736,099 S 8/2015 Deuerer ..... D09/707
D739,727 S 9/2015 Olson ..... D9/436
9,144,278 B2 * 9/2015 Morrow ..... A45C 3/04
D750,334 S 2/2016 Comstock ..... D32/30
D755,017 S 5/2016 Piechocinski ..... D07/584

(56) References Cited

U.S. PATENT DOCUMENTS 9,371,153 B1 6/2016 Nouri et al.
D770,916 S 11/2016 Nouri et al. ..... D09/709
D772,493 S 11/2016 Wu ..... D30/129
D772,723 S 11/2016 Murray ..... D9/707
D782,450 S 3/2017 Jones ..... D14/240
D784,157 S * 4/2017 Ross ..... D9/705
D791,609 S 7/2017 Rotman ..... D9/611
9,737,161 B1 8/2017 Li ..... A47G 19/22
9,751,655 B2 9/2017 Herman
D804,959 S 12/2017 Anda ..... D9/705
D809,875 S 2/2018 Delgado Carmona ..... D7/628
D809,876 S 2/2018 Delgado Carmona ..... D7/628
D811,796 S 3/2018 Joseph ..... D7/325
D812,487 S 3/2018 Soegyanto ..... D9/702
D813,684 S 3/2018 Williams, Jr. et al. ..... D9/703
D815,365 S 4/2018 Scariot et al. ..... D30/118
D815,544 S 4/2018 Soegyanto ..... D9/702
D817,109 S 5/2018 Kilicarslan ..... D7/611
D826,063 S 8/2018 Kwon et al. ..... D9/643
D831,432 S 10/2018 Lv ..... D7/606
D851,853 S 6/2019 Khan ..... D99/5
D854,325 S 7/2019 Myerson ..... D3/304
D856,086 S 8/2019 Goulet ..... D7/519
D858,200 S 9/2019 Wang ..... D7/516
D860,001 S 9/2019 Sahatjian ..... D9/707
10,407,217 B1 * 9/2019 Nouri ..... B29C 43/18
10,421,584 B2 * 9/2019 Ross ..... B65D 33/2508
D874,876 S * 2/2020 Finell ..... D7/602
D876,172 S * 2/2020 Finell ..... D7/602
D876,891 S 3/2020 Finell et al. ..... D7/509
D886,533 S 6/2020 Finell et al. ..... D7/602
D886,534 S 6/2020 Finell et al. ..... D7/602
D889,205 S 7/2020 Said ..... D7/523
D904,896 S 12/2020 Unterlechner ..... D9/703
D904,897 S 12/2020 Unterlechner ..... D9/703
D905,564 S 12/2020 Unterlechner ..... D9/703
2003/0066870 A1 4/2003 Stewart ..... 229/125.09
2004/0004010 A1 * 1/2004 Versluys ..... B65D 75/5883 206/219
2004/0146224 A1 * 7/2004 Piotrowski ..... B65D 31/10 383/64
2004/0211879 A1 10/2004 Stalnecker et al. ..... 249/121
2004/0244413 A1 * 12/2004 Trinh ..... A61F 7/103 62/530
2005/0194386 A1 9/2005 Shai ..... 220/287
2006/0093242 A1 5/2006 Anzini et al. ..... 383/63
2006/0171609 A1 * 8/2006 Turvey ..... B65D 33/2508 383/63
2006/0191929 A1 8/2006 Berg, Jr. et al. ..... 220/6
2006/0191985 A1 8/2006 Norcom ..... 229/117.05
2006/0193541 A1 8/2006 Norcom ..... 383/200
2007/0130733 A1 * 6/2007 Kasai ..... B29C 66/836 24/585.12
2007/0164192 A1 * 7/2007 Holden ..... F25C 1/243 249/98
2007/0175787 A1 * 8/2007 Lown ..... A45F 3/16 206/427
2008/0050053 A1 2/2008 Szczesuil et al. ..... 383/66
2008/0063318 A1 * 3/2008 Gattino ..... B65D 33/004 383/21
2008/0087268 A1 4/2008 Burton ..... 126/9 R
2008/0089618 A1 * 4/2008 Blythe ..... B65D 33/08 383/25
2008/0277310 A1 * 11/2008 Chacon ..... B65D 77/062 206/568
2009/0110335 A1 4/2009 Leboeuf ..... 383/63
2009/0136161 A1 * 5/2009 Hickey ..... B65D 33/1691 383/66
2009/0279810 A1 11/2009 Nobles ..... 383/66
2010/0012531 A1 1/2010 Steele ..... 206/216
2010/0072224 A1 3/2010 Ha ..... 222/107
2010/0159083 A1 * 6/2010 Peplinski ..... B65D 81/3266 426/113
2010/0159096 A1 * 6/2010 Sam ..... B65D 33/2591 426/394
2010/0300919 A1 * 12/2010 Alipour ..... B65D 33/2591 206/524.8
2010/0314434 A1 12/2010 Herman ..... 229/107
2011/0017812 A1 1/2011 Belko et al. ..... 229/117.27
2011/0017814 A1 1/2011 Belko et al. ..... 229/124
2011/0132910 A1 6/2011 Willat et al. ..... 220/495.03
2011/0203944 A1 8/2011 Singer ..... 206/204
2011/0297680 A1 12/2011 Howell et al. ..... 220/266
2012/0060449 A1 3/2012 Howell et al. ..... 53/456
2012/0187182 A1 7/2012 Howell et al. ..... 229/102
2012/0269469 A1 10/2012 Long et al. ..... 383/210.1
2013/0084028 A1 4/2013 Cross ..... 383/33
2013/0105352 A1 5/2013 Munguia ..... 206/524.6
2013/0277367 A1 * 10/2013 Kozarsky ..... B65D 15/00 220/315
2014/0042217 A1 2/2014 Houck ..... 229/404
2014/0212075 A1 7/2014 Cross ..... 383/64
2014/0226921 A1 8/2014 Albers ..... 383/86.2
2014/0245698 A1 9/2014 Steele ..... 53/410
2014/0270579 A1 9/2014 Nouri ..... 383/25
2015/0202832 A1 * 7/2015 Denis ..... B29C 66/8167 383/63
2015/0203250 A1 7/2015 Denis et al. ..... 383/63
2016/0137374 A1 * 5/2016 Brosch ..... B65D 75/002 383/104
2016/0145030 A1 * 5/2016 Malligan ..... B65D 65/14 426/120
2017/0036822 A1 * 2/2017 Sam ..... B65D 33/2591
2018/0148228 A1 * 5/2018 Bray ..... B65D 33/2508
2018/0251267 A1 9/2018 Finell ..... B65D 33/2508
2018/0370109 A1 * 12/2018 Shaw ..... B29C 48/92
2019/0270546 A1 9/2019 Finell

FOREIGN PATENT DOCUMENTS

JP D140735 S 11/2010
JP D1454613 S 11/2012
JP 1481231 S 10/2013
JP 1611864 S 8/2018
JP D1625224 S 2/2019
JP D1630549 S 5/2019
JP D1630736 S 5/2019
JP 1655101 S 3/2020
JP 1661295 S 6/2020
TW M515388 1/2016 ..... A61J 1/05
WO 98/12488 A1 3/1998 ..... B65D 33/25
WO 2016/140746 A1 9/2016 ..... G06F 19/00

OTHER PUBLICATIONS

Extended European Search Report and Written Opinion, Application No. 18159842.6, 9 pages, dated Oct. 19, 2018.
U.S. Non-Final Office Action, U.S. Appl. No. 15/910,757, 18 pages, dated Jun. 14, 2019.
U.S. Non-Final Office Action, U.S. Appl. No. 29/618,115, 27 pages, dated Nov. 27, 2019.
U.S. Non-Final Office Action, U.S. Appl. No. 29/618,138, 27 pages, dated Nov. 29, 2019.
U.S. Non-Final Office Action, U.S. Appl. No. 29/618,099, 27 pages, dated Nov. 29, 2019.
U.S. Notice of Allowance, U.S. Appl. No. 29/699,278, 19 pages, dated Dec. 4, 2019.
U.S. Notice of Allowance, U.S. Appl. No. 29/699,301, 19 pages, dated Dec. 4, 2019.
U.S. Notice of Allowance, U.S. Appl. No. 29/699,897, 18 pages, dated Dec. 4, 2019.
U.S. Notice of Allowance, U.S. Appl. No. 29/699,904, 19 pages, dated Dec. 4, 2019.
U.S. Non-Final Office Action, U.S. Appl. No. 15/910,757, 21 pages, dated 8, 2020.
Chinese Office Action, Application No. 201830098713.5, 1 page, dated Jul. 5, 2018.
Chinese Office Action, Application No. 201830099279.2, 1 page, dated Jul. 9, 2018.

(56) References Cited

OTHER PUBLICATIONS

Chinese Office Action, Application No. 201830098714.X, 1 pages, dated Jul. 11, 2018.
Chinese Office Action, Application No. 201830099010.4, 1 page, dated Jul. 11, 2018.
Taiwan Office Action, Application No. 107301545, 6 pages, dated Sep. 12, 2018.
Taiwan Office Action, Application No. 107301546, 5 pages, dated Sep. 12, 2018.
Taiwan Office Action, Taiwan Design Application No. 107301543, 4 pages, dated Dec. 18, 2018.
International Search Report and Written Opinion, Application No. PCT/US2019/054935, 11 pages, dated Feb. 4, 2020.
Taiwan Office Action, Application No. 107301546, 30 pages, dated Feb. 10, 2020.
Taiwan Office Action, Application No. 107301545, 20 pages, dated Feb. 10, 2020.
International Search Report and Written Opinion, Application No. PCT/US2020/017893, 12 pages, dated May 20, 2020.
U.S. Advisory Action, U.S. Appl. No. 16/154,134, 4 pages, dated Jun. 12, 2020.
Japanese Office Action, Application No. 2020001090, 9 pages, dated Jun. 15, 2020.
Japanese Office Action, Application No. 2020001093, 9 pages, dated Jun. 15, 2020.
Japanese Office Action, Application No. 2020001101, 8 pages, dated Jun. 15, 2020.
Japanese Office Action, Application No. 2020001087, 8 pages, dated Jun. 15, 2020.
Japanese Office Action, Application No. 2020001088, 8 pages, dated Jun. 15, 2020.
Japanese Office Action, Application No. 2020001089, 9 pages, dated Jun. 15, 2020.
U.S. Final Office Action, U.S. Appl. No. 15/910,757, 28 pages, dated Jul. 8, 2020.
U.S. Non-Final Office Action, U.S. Appl. No. 16/154,134, 29 pages, dated Sep. 24, 2020.
U.S. Advisory Action, U.S. Appl. No. 15/910,757, 6 pages, dated Oct. 15, 2020.
U.S. Non-Final Office Action, U.S. Appl. No. 15/910,757, 21 pages, dated Oct. 2, 2018.
U.S. Final Office Action, U.S. Appl. No. 15/910,757, 17 pages, dated Feb. 21, 2019.
U.S. Final Office Action, U.S. Appl. No. 15/910,757, 22 pages, dated Sep. 18, 2019.
U.S. Non-Final Office Action, U.S. Appl. No. 16/154,134, 39 pages, dated Oct. 1, 2019.
U.S. Non-Final Office Action, U.S. Appl. No. 29/699,634, 14 pages, dated Oct. 21, 2019.
U.S. Non-Final Office Action, U.S. Appl. No. 29/699,650, 14 pages, dated Oct. 21, 2019.
U.S. Non-Final Office Action, U.S. Appl. No. 29/699,656, 14 pages, dated Oct. 21, 2019.
U.S. Advisory Action, U.S. Appl. No. 15/910,757, 3 pages, dated Oct. 28, 2019.
U.S. Notice of Allowance, U.S. Appl. No. 29/699,611, 16 pages, dated Oct. 30, 2019.
Chinese Office Action, Application No. 201810176215.7, 6 pages, dated May 27, 2021.
Japanese Office Action, Application No. 20201088, 6 pages, dated Jun. 1, 2021.
Japanese Office Action, Application No. 20201089, 6 pages, dated Jun. 1, 2021.
Japanese Office Action, Application No. 20201090, 6 pages, dated Jun 1, 2021.
Japanese Office Action, Application No. 20201093, 6 pages, dated Jun. 1, 2021.
Japanese Office Action, Application No. 20201087, 6 pages, dated Jun. 1, 2021.
U.S. Non-Final Office Action, U.S. Appl. No. 29/699,320, 38 pages, dated Jun. 30, 2021.
U.S. Non-Final Office Action, U.S. Appl. No. 29/699,437, 38 pages, dated Jun. 30, 2021.
U.S. Non-Final Office Action, U.S. Appl. No. 29/699,459, 38 pages, dated Jun. 30, 2021.

* cited by examiner

SECTION C-C

SECTION D-D

SECTION E-E

SECTION G-G

SECTION C-C

SECTION D-D

FLEXIBLE CONTAINER WITH ICE TRAY

CONTINUATION STATEMENT

This application is a continuation-in-part of U.S. application Ser. No. 16/154,134, filed Oct. 8, 2018, which is a continuation-in-part of U.S. application Ser. No. 15/910,757, filed Mar. 2, 2018.

TECHNICAL FIELD

The present disclosure relates generally to the field of sealable cups, bowls and tumblers made of silicone with ice cube making compartments.

BACKGROUND

U.S. Pat. No. 6,197,359, incorporated herein by reference, describes the use of silicone for manufacturing of confectionery molds and baking receptacles, wherein silicone may be used for applications in contact with foodstuffs, in particular, methyl-vinyl-polysiloxane obtained by a process of cross-linking with platinum. Silicone is a material of polymeric nature whose chains are made up of alternating oxygen and silicon atoms. Silicones are normally prepared by hydrolysis and subsequent polymerisation of alkylhalogensilanes (both acid- and base-catalysed). The alkylhalogensilanes are in practice made by a direct process, Cu-catalysed, in which the Si reacts with the corresponding alkyl halide. This process provides mixtures of products, whose composition can be modified by a process of redistribution to yield the desired monomer. Known in the art are silicone elastomers, which are made up of linear polymers. A cross-linking phase is required in order to provide the elastic properties. The most common elastomers are those deriving from dichloromethylsilane, with molecular weights ranging between 300,000 and 700,000. They are made by a prepolymerisation that provides octamethylcyclotetrasiloxane, purification thereof and subsequent polymerisation in the presence of a small quantity of monofunctional material in order to control the molecular weight, followed by a cross-linking similar to curing, in the presence of peroxides, which lends the material its elastic properties. Other important elastomers are those that contain a small proportion (0.1% molar) of vinyl groups linked to silicon, which undergo much more effective curing, and those that contain between 10 and 15% molar of phenyl groups, and good elastic properties at low temperatures. Elastomers of a much lower molecular weight (10,000 to 100,000) can be obtained by using linear polymer chains ending in silanol groups, which can be cured at room temperature by reaction with an alkoxylane. In general, the most important characteristic of the silicone elastomers is the fact that they present a very broad thermal spectrum of use (from −50° C. to 200° C.) without a significant alteration of their properties. They have good electrical insulation properties, do not self-oxidise or undergo attack by chemical agents in aqueous medium and swell in the presence of non-polar organic solvents, although some special types that contain fluoro- or cyano-groups offer greater resistance to this process. Silicone elastomers find their widest industrial application as electrical insulators, fluid-repellents and oxidation protectors, and in the manufacturing of hermetic gaskets. The silicones are highly inert materials, and they repel water. Silicone is inert to chemical agents, with the exception of strong bases and acids, and its toxicity is generally low. The origin of these properties lies essentially in the high stability of the Si—O bond (106 Kcal/mol), and in its strong partial ionic character. Other known uses of silicones are in the manufacturing of containers for liquids (such as wineskins) and tubes for transporting substances (such as the tubes used for blood transfusions).

U.S. Publication 2014/0270579, incorporated herein by reference, discloses a silicone bag. In particular, the publication teaches a bag having a front and back portion which are comprised of silicone or a similar elastomer. The front and back portion are identical in size and are sealed together along their sides and bottom with a mouth along the top portion. The mouth creates a cavity from which items are placed in and stored or transported for further use. A sealing mechanism (ribs pressed into slots) on top of the bag seals items in the bag. The bag is molded entirely of silicone, including the sealing mechanism, to be water tight.

U.S. Publication 2014/0245698, incorporated herein by reference, discloses a package having a foldable top region. The package generally includes panel portions that at least partially define an interior cavity there between and accessible through an access mouth. The top portion can provide a cuff member or cuff region that can be folded and unfolded to facilitate use of the package as a bowl or other cuffed container for material contents. The package can be adapted to hold its shape as a bowl or cuffed container. A reclosure member can be provided to facilitate re-sealing of the package. A folding strip, edge contours and stiffening members can also be provided.

U.S. Publication 2009/0110335, incorporated herein by reference, discloses a reclosable food storage bag able to withstand a wide temperature range manufactured from environmentally sensitive materials is disclosed. The bag can be manufactured from such materials as silicone rubber and thermoset resins. By using such materials, the bag can easily withstand the temperature ranges encountered in residential kitchens extending from the freezer to the oven and all ambient temperatures there between. In addition, by manufacturing the bag from such materials, the environmental impact of using petroleum based polymers is avoided.

U.S. Pat. No. 9,371,153, incorporated herein by reference, discloses a container made of an elastomer such as silicone with an integrated leak resistant seal having press-fit elements. The sizes and shapes of the press-fit elements seal the mouth to resist leakage of liquids from inside the container. No external clips or clasps are needed for the seal. Extended flaps facilitate pulling the sides open. The container itself may be of asymmetrical shape, e.g. trapezoidal.

U.S. Pat. No. 3,844,525, incorporated herein by reference, discloses a one-piece freezing tray having at least one molding compartment for forming ice cubes.

SUMMARY

In accordance with the teachings of the present disclosure, ice-making containers having shapes such as cups, bowls and tumblers with compartments for ice cubes are provided that have spouts and zipper members for sealing the mouth of the container. The containers may be made of silicone. The containers may be closed tightly to seal the opening to prevent or at least limit air, liquid, or other material from getting in or out.

An aspect of the invention provides an ice-making container comprising: a base and a freestanding side extending from the base to define a mouth opposite the base; at least one divider extending from at least one of the base and the freestanding side so as to divide the container into at least two ice-making compartments; a first zipper member extending from a first interior portion of the mouth; a second zipper member extending from a second interior portion of the mouth, wherein the mouth is deformable between open and closed configurations and the first and second zipper members are disengagable when the mouth is open and engagable when the mouth is closed, wherein the base, freestanding side, at least one divider, and zipper members are a unitary whole container without assembled parts, wherein the container comprises silicone.

A further aspect of the invention provides an ice-making container made by a molding process, wherein the ice-making container comprises: a base and a freestanding side extending from the base to define a mouth opposite the base; at least one divider extending from at least one of the base and the freestanding side so as to divide the container into at least two ice-making compartments; a first zipper member extending from a first interior portion of the mouth; a second zipper member extending from a second interior portion of the mouth, wherein the mouth is deformable between open and closed configurations and the first and second zipper members are disengagable when the mouth is open and engagable when the mouth is closed, wherein the base, freestanding side, at least one divider, and zipper members are a unitary whole container without assembled parts, wherein the container comprises silicone, wherein the molding process comprises a silicone molding process selected from liquid injection molding, compression molding, and transfer molding.

BRIEF DESCRIPTION OF THE DRAWINGS

A more complete understanding of the present embodiments may be acquired by referring to the following description taken in conjunction with the accompanying drawings, in which like reference numbers indicate like features.

DETAILED DESCRIPTION

Figure 1A:
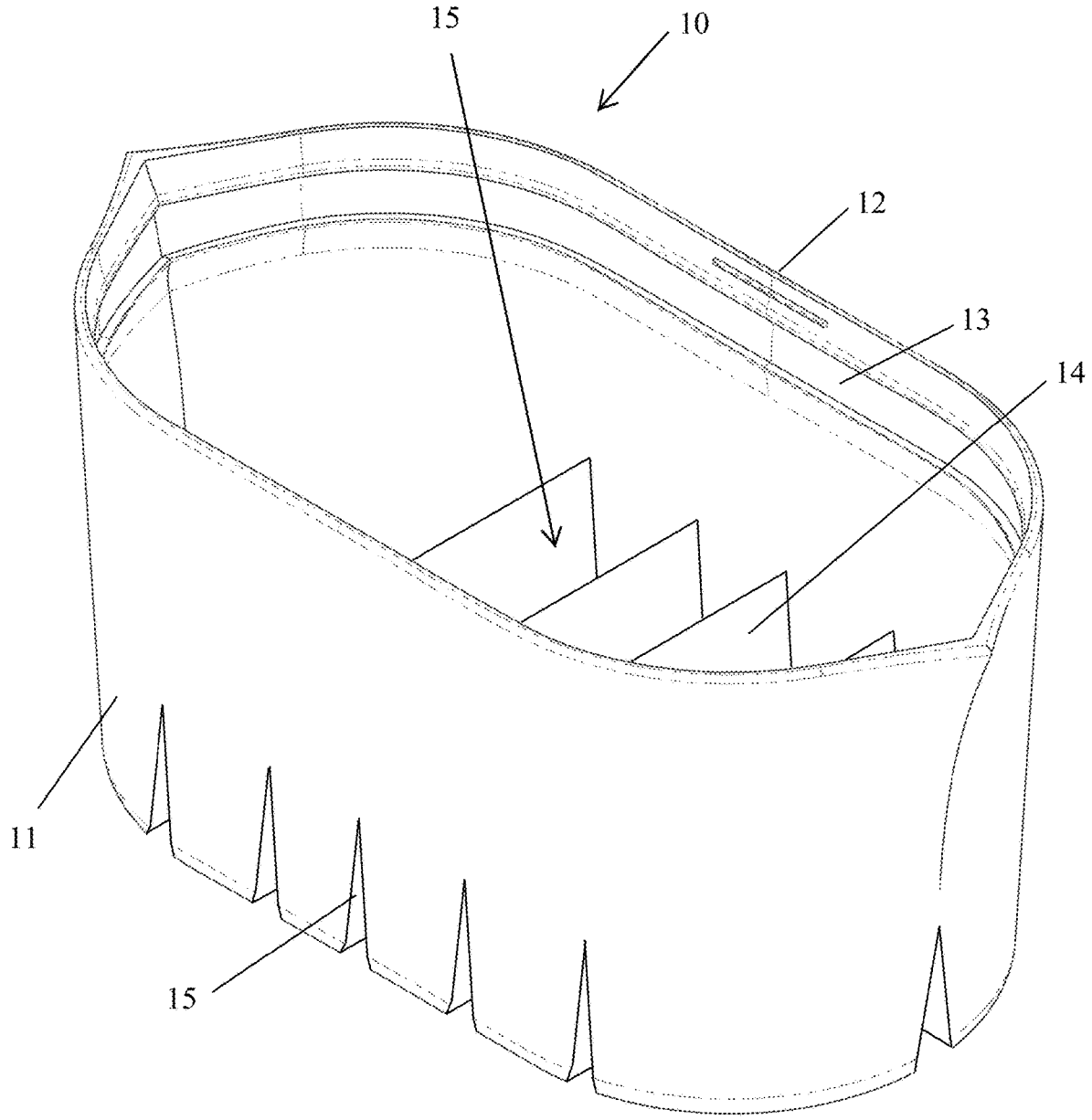
FIG. 1A illustrates a perspective view of an ice-making container in an open configuration.

Preferred embodiments are best understood by reference to FIGS. 1A-8E below in view of the following general discussion. The present disclosure may be more easily understood in the context of a high level description of certain embodiments.

Embodiments of the present invention provide a cup or a bowl ice tray, for example, that stands on its own and zips at the top like a re-sealable zipper storage bag. A fluid, such as water, juice, etc. may be poured into the container to fill the compartments in the bottom thereof, the container may be zipped shut, the container may be placed in freezer until the fluid is solidified, the container may be removed from the freezer and deformed to break the ice free from the compartments, and further liquids or foods may be added to the container for a beverage or edible treat. The cup or bowl ice tray container may be made with silicone in one piece, be flexible, be food grade, and be dishwasher/microwave safe. The cup or bowl ice tray container may be used as a dish/cup even though there are compartments in the bottom thereof. The cup or bowl ice tray container may be used as a storage container. In particular, the cup or bowl ice-maker may be great for travel, and use with ice chests or cooler boxes.

With the zipper seal to close the mouth of the container, the contents of the ice-making compartments may remain clean and free of debris or freezer burn. The sealed contents may preserve fresh flavors, textures and nutrients. The container having a zipper seal of the mouth may help to prevent contamination, freezer burns and food/drink spillage.

Embodiments of the ice-making container may be useful to freeze baby food, wherein liquified food may be placed in the compartments, frozen, and then popped out of the compartments for service.

The ice-making compartments may be sufficiently flexible so as to enable a user to squeeze, press, push, etc. the exterior of the compartment to dislodge an ice-cube from the interior of the compartment. Because the all-in-one ice tray/container has a zipper seal to close the mouth of the container, the solid contents may be popped out of the cube forming compartments while remaining fully captured in the closed container, so that no other container is needed. The zipper closure may then be opened to pour the solid cubes into glasses, cups or other service ware.

An ice-making container in the shape of a cup may be used as a cup, where ice cubes may be frozen in the compartments in the bottom and then a beverage may be added for consumption directly from the cup.

While called an ice-making container, because it may be ideal to make ice cubes, the container may also be ideal to cook foods in a conventional oven, a microwave oven, or submerged in heated water. For example, the compartments may facilitate preparation of cup cakes or other individual serving size food items, wherein they may be prepared, cooked, and stored, all in the same container.

The material may be thicker at the base for stability and to form the ice-making compartments. The top may be thinner and more flexible. The zipper may be a tongue and groove configuration wherein a male portion is mated with a female portion to make the seal. The zipper may be a dual zipper or triple zipper. A clasp may be assembled to the exterior of the zipper for sliding along the zipper to assist with the mouth and/or closing of the zipper. The zipper may comprises male and female members that engage to seal the mouth. For purposes of this disclosure the mouth is considered sealed by the zipper members when the zipper members engage sufficiently to remain closed independent of any outside influences and retain water inside an up-side-down container. Containers may hold between 1 and 20 cups of water volume. Containers may hold more fluid depending on the application and the amount of ice to be made.

The ice-making container with zipper members may be molded as one unitary whole, in particular, without assembled parts. For example, to make a container that is a unitary whole without assembled parts, the entirety of the container with all its parts including zipper members may be compression molded, liquid injection molded, transfer molded or molded by any similar process. Overmolding may be included in these molding processes, wherein the zipper members and/or dividers may first be separately molded and then placed inside the container mold so that when the container is molded, the zipper members and/or dividers become "overmolded" or "encapsulated" by the liquid silicone being injected in the mold to form the container, and thereby become a unitary whole with the container. The zipper members and container may be made to become a unitary whole by separately forming or molding and then placing them in contact when the silicone material when it is not fully crosslinked (cured), and then postbaking the parts to vulcanize the whole thing. The zipper members or other portions of the container may be made from a harder durometer or different material injected into the mold, so that it may be a dual-durometer or co-molded product.

Silicone, in particular, platinum cured silicone may be used. A silicone having a durometer of between 30-80 shore A, for example, may be used. The silicone may have an elongation break between 290% and 620%. The silicone may have a tear strength of 21-33 N/mm. In other embodiments, titanium silicone may be used.

One aspect of the invention is to use a liquid silicone rubber injection mold process to make the container as a single unitary product. Uncured liquid silicone rubber may start as two materials: a base-forming material and a catalyst. The materials may be released into a mixing chamber, wherein color pigmentations or other additives may also be released into the mixing chamber. A specific volume may be injected into the mold as an appropriate shot size for each job. Temperature, pressure, injection rate and cycle time may be adjusted depending on the size and shape of the container being molded. The mold may comprise two or more plates. Liquid silicone rubber may be injected into a preheated mold to push the material into the mold and cavities therein. The liquid silicone rubber is cured in the mold by the application of heat and pressure until it solidifies. A rate of silicone shrinkage should be considered. Because silicone is an elastic material, flashing may occur when removed from the cavity of a mold. Flashing can be removed from the molded container automatically or manually.

Another aspect of the invention is to use a high consistency silicone rubber compression mold process to make the container as a single unitary product. Granular bulk silicone material is pre-catalyzed by adding powder. An exact amount of silicone required to make the container is determined. A determined amount of silicone is cut and weighed and strategically placed in a mold cavity. The silicone material may be pre-shaped to the approximate configuration of the container so that it fills all portions of the interior of the mold. The mold is heated to 300 degrees Celsius or higher as force is applied by compressing the silicone between the plates of the mold to flow the silicon into the cavities of the mold. The silicone is cured or vulcanized by an irreversible chemical reaction under heat and pressure to make a highly cross-linked molecular structure. The mold is opened and the molded container is removed. Flashing can be removed from the molded container automatically or manually.

According to certain embodiments of the invention, one feature is to have a free standing ice-making container with a zipper seal of the mouth at the top, wherein the mouth remains open when unsealed. A benefit to users is that the mouth of the ice-making contain remains open in a free standing position, so users may pour or spoon contents into or out of the ice-making container without having to hold open the mouth of the ice-making container. To enable this feature, the ice-making container may be silicone molded in in an open position, so that the finished ice-making container naturally wants to assume an open position. The zipper members may be silicone molded in straight molds so that by themselves they naturally tend to assume straight positions. When the zipper members are then joined in zipper slots of the ice-making container, the combination tends to cause the mouth of the ice-making container to naturally assume an open eye-shape when free-standing. The ice-making container may be sufficiently flexible to allow a force applied to the exterior may deform the container so that ice frozen inside the container may easily be broken into smaller fragments.

The figures show perspective, side and end views of separate cup-shaped, bowl-shaped or other ice-making containers. Each cup-shaped and bowl-shaped ice-making container is made of a flexible material that is sufficiently rigid in the base regions to stand on their own, but sufficiently flexible in the closure region to allow the mouths to transition between open and closed configurations.

Figure 1B:
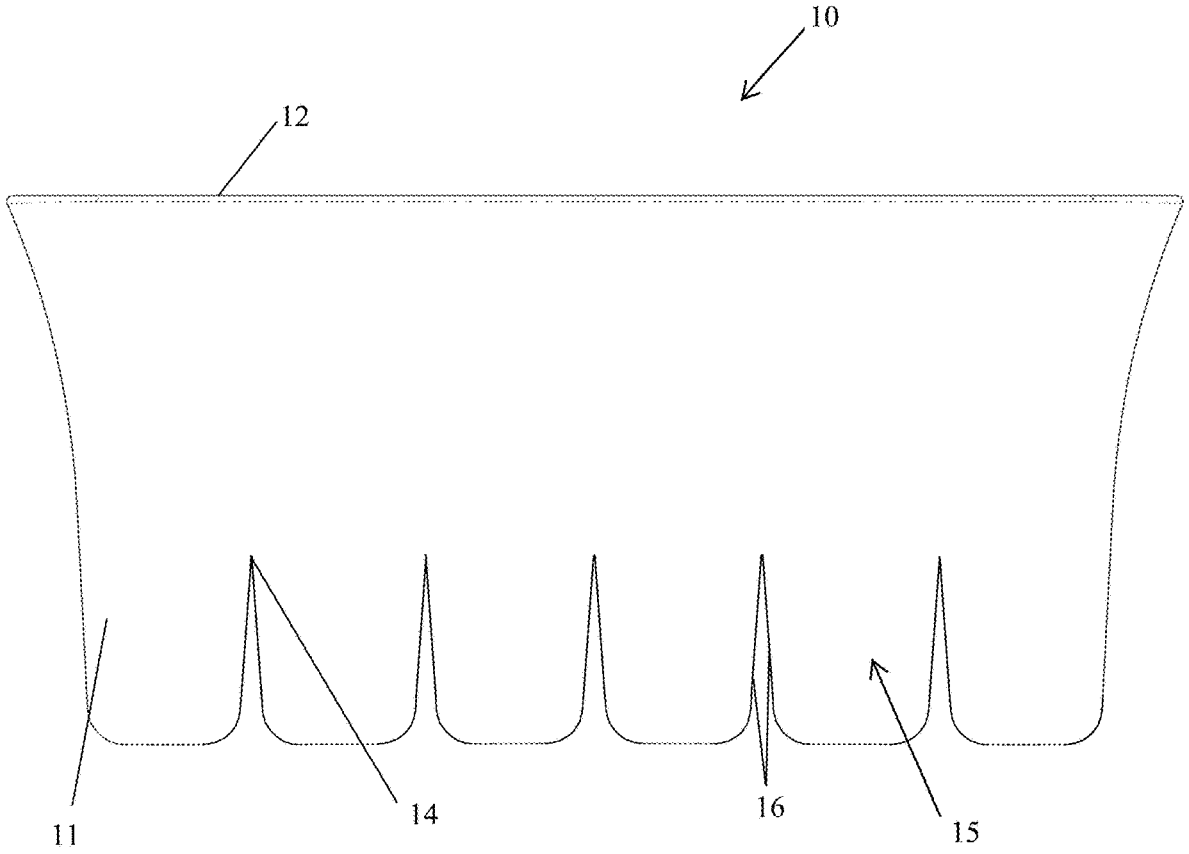
FIG. 1B shows a side view of the ice-making container in an open configuration shown in FIG. 1A, wherein compartments are defined by dividers.
Figure 1C:
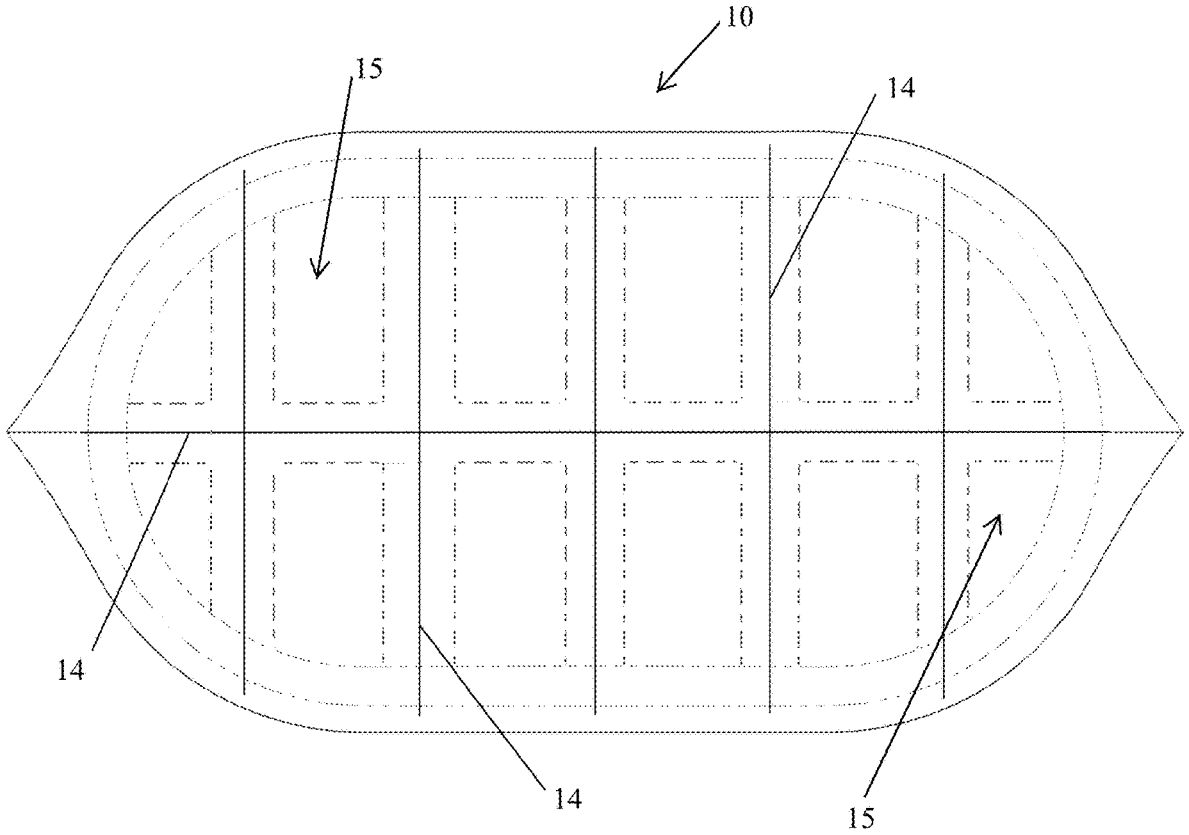
FIG. 1C shows a top view of the ice-making container of FIGS. 1A and 1B, wherein twelve compartments are visible.
Figure 1D:
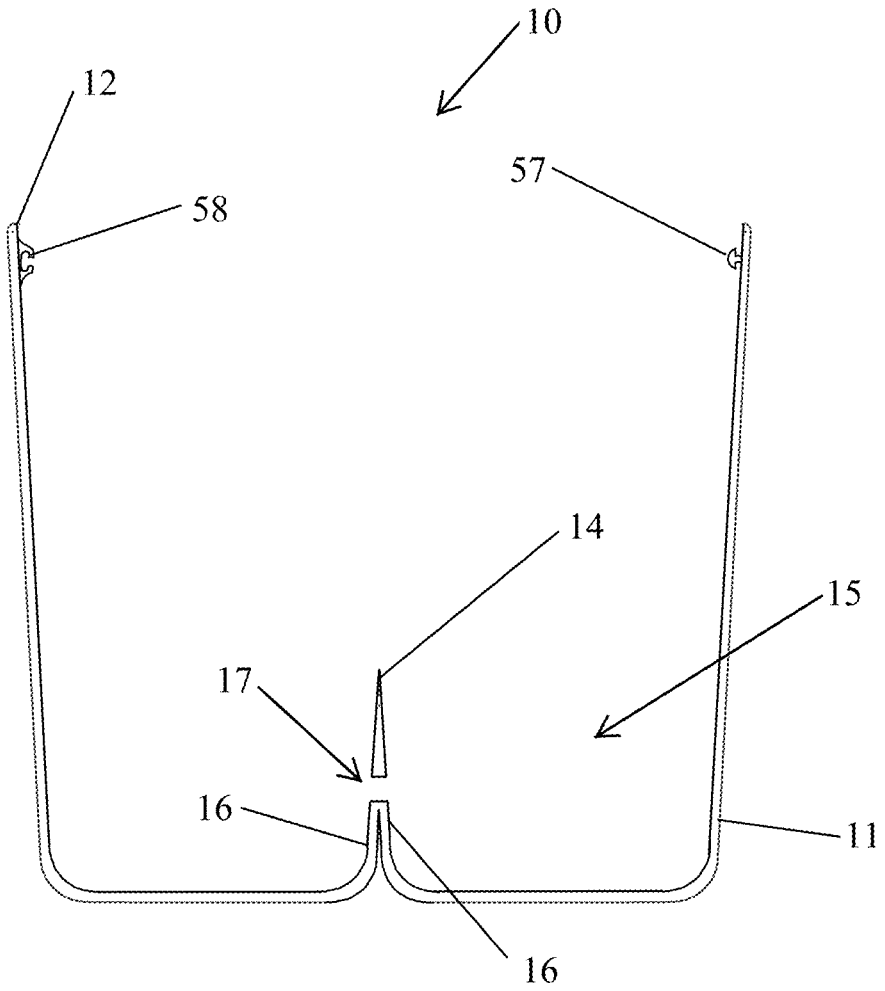
FIG. 1D is a cross-sectional end view of the ice-making container of FIGS. 1A-1C, wherein divider separates two compartments for making ice-cubes.

FIGS. 1A-1D show perspective, side, top and cross-sectional views of a bowl-shaped ice-making container. FIG. 1A is a perspective view of the ice-making container in an open configuration wherein the view is looking down through the mouth into the interior of the ice-making container. FIG. 1B is a side view of the ice-making container in an open configuration. FIG. 1C is a top view of the ice-making container in an open configuration, wherein dividers defining compartments for making ice cubes are visible. FIG. 1D is a cross-sectional side view of the ice-making container in an open configuration.

FIG. 1A is a perspective view of the ice-making container in an open configuration wherein the view is looking down through the mouth into the interior of the ice-making container. The ice-making container 10 comprises a base 11 that is generally oval in shape. The ice-making container 10 further comprises a mouth 12 at the top, wherein the mouth is generally circular when open and general linear when closed. The base 11 comprises a wall thickness and material composition that has sufficient stiffness or rigidity to resist somewhat deformation in response to applied forces. The mouth 12 comprises wall thicknesses and material compositions that are sufficiently flexible or pliable to allow the mouth 12 to be deformed between open and closed configurations. In one embodiment, the ice-making container 10 may have wall thicknesses or rigidity that vary uniformly from the base 11 to the mouth 12, wherein the wall thicknesses are thicker or more rigid at the base 11 and thinner or less rigid at the mouth 12. The ice-making container 10 may have a zipper 13 near the mouth 12 to seal the mouth in a closed configuration, wherein the zipper 13 may have male and female zipper elements, not shown. The base 11 may have dividers 14 to define compartments for making ice.

FIG. 1B is a side view of the ice-making container in an open configuration. In this embodiment, the dividers 14 are dual-walled so as to define compartments for ice-cubes that are smaller at the bottoms than at the tops. The walls 16 of the dividers join at the top and angle away from each other toward the bottom. With angled walls 16, the compartments 15 are wider at their tops and narrow in their bottoms, which enables ice-cubes to more easily pop out of the compartments 15. In alternative embodiments, the dividers may take any shape or configuration to facilitate the making of ice-cubes.

FIG. 1C is a top view of the ice-making container in an open configuration, wherein dividers defining compartments for making ice cubes are visible. In this embodiment, the bowl-shaped ice-making container 10 has twelve compartments 15 for making ice-cubes. In alternative embodiments, any number of compartments may be used. The interior compartments 15 are generally rectangular and the compartments in the ends of the container are more triangular in shape. In alternative embodiments, the compartments may take any shape or configuration to facilitate the making of ice-cubes.

FIG. 1D is a cross-sectional side view of the ice-making container in an open configuration. In the mouth 12 of the container 10, there is a male zipper member 57 and a female zipper member 58. The divider 14 is shown in cross-section comprising two walls 16 that join together at the top. The compartments 15 are defined by the divider 14 and the exterior walls of the ice-making container 10. In this embodiment, the divider 14 has a fluid conduit in the form of a port 17 through it to allow fluid to flow freely between adjacent compartments 15. Ports 17, which fluidly connect the compartments 15, may allow fluid to flow freely between the compartments 15 so that the amount of fluid in each compartment may be about the same. An even distribution of fluid in the compartments 15 may produce ice-cubes of about the same size. Some embodiments of the ice-making container 10 will not have ports 17 in its dividers 14. In other embodiments of the ice-making container 10, rather than ports, the fluid conduit may be a notch (not shown) formed in the top of the divider to allow fluid to spill through the notch from one compartment to another. The fluid conduits (ports, notches, etc.) may be large enough to allow fluid to flow between compartments, but not so large to make it difficult to break and separate ice-cubes formed in adjacent compartments.

Figure 2A:
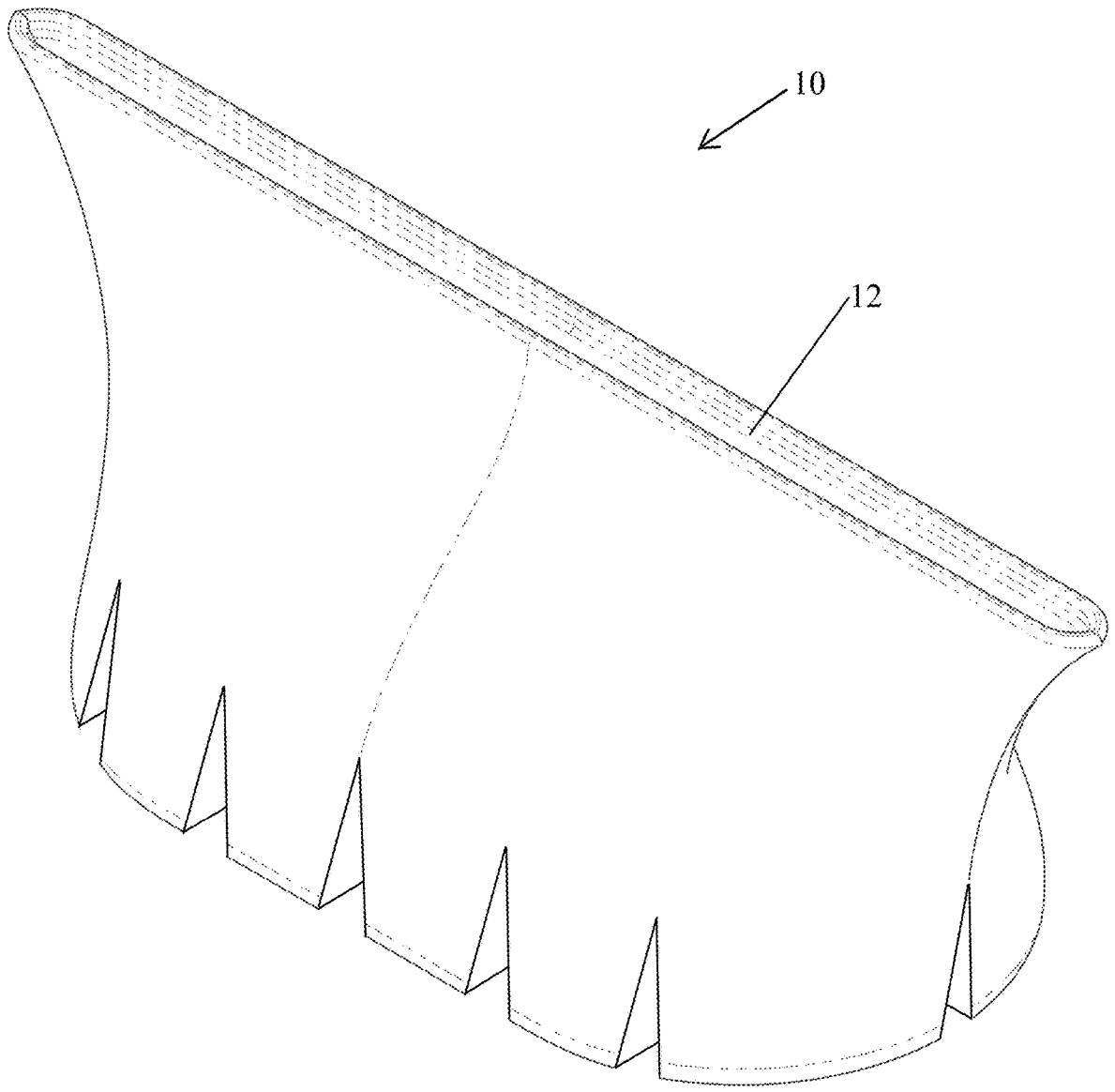
FIGS. 2A and 2B illustrate perspective and end views, respectively of the ice-making container of FIGS. 1A-1D in a closed configuration.
Figure 2B:
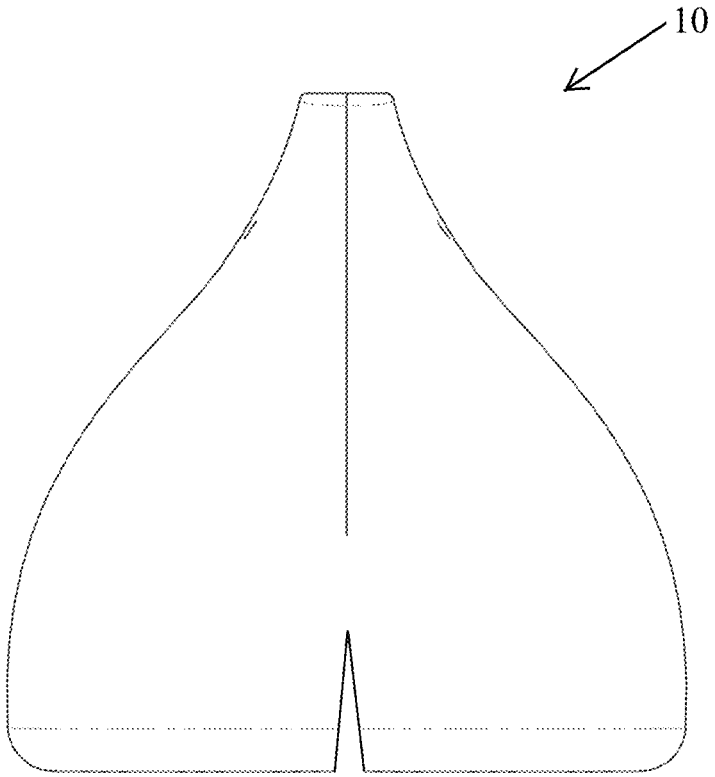

FIG. 2A is a perspective view of the bowl-shaped ice-making container 10 of FIGS. 1A-1D in a closed configuration, wherein the view is looking down at the closed mouth 12 of the ice-making container 10. FIG. 2B is an end view of the ice-making container 10 in a closed configuration, wherein the view from each end is identical.

In alternative embodiments, the base 11 of the ice-making container 10 may be any geometric shape, for example, square, rectangle, triangle, octagon, hexagon, oval, etc. Further, the mouth 12 may also be of any geometric shape. Still further, cross-sections of the ice-making container 10 between the base 11 and the mouth 12 may be of any geometric shape. In some embodiments of the invention, the base 11, mouth 12, and cross-sections between the base 11 and mouth 12 all have the same geometric shape. In still other embodiments of the invention, the base 11, mouth 12, and cross-sections between the base 11 and mouth 12 have different geometric shapes.

Some embodiments of the invention, made of silicone, have base and sidewall thicknesses greater than 0.5 mm. Other embodiments of the invention, made of silicone, have base and sidewall thicknesses between about 0.7 mm and about 1.3 mm. Still further embodiments of the invention, made of silicone, have base and sidewall thicknesses of about 1.0 mm.

The ice-making containers may be made of silicone material that is either transparent or opaque and made to be any color. The silicone may be of a quality and composition appropriate for applications in contact with foodstuffs. In particular, methyl-vinyl-polysiloxane obtained by a process of cross-linking with platinum may be an appropriate silicone. Material may include polyurethane rubber, tin-cured silicone rubber, and platinum-cured silicone rubber. Numeric markers may be added to indicate volumetric measurements within the ice-making containers.

Figure 3:
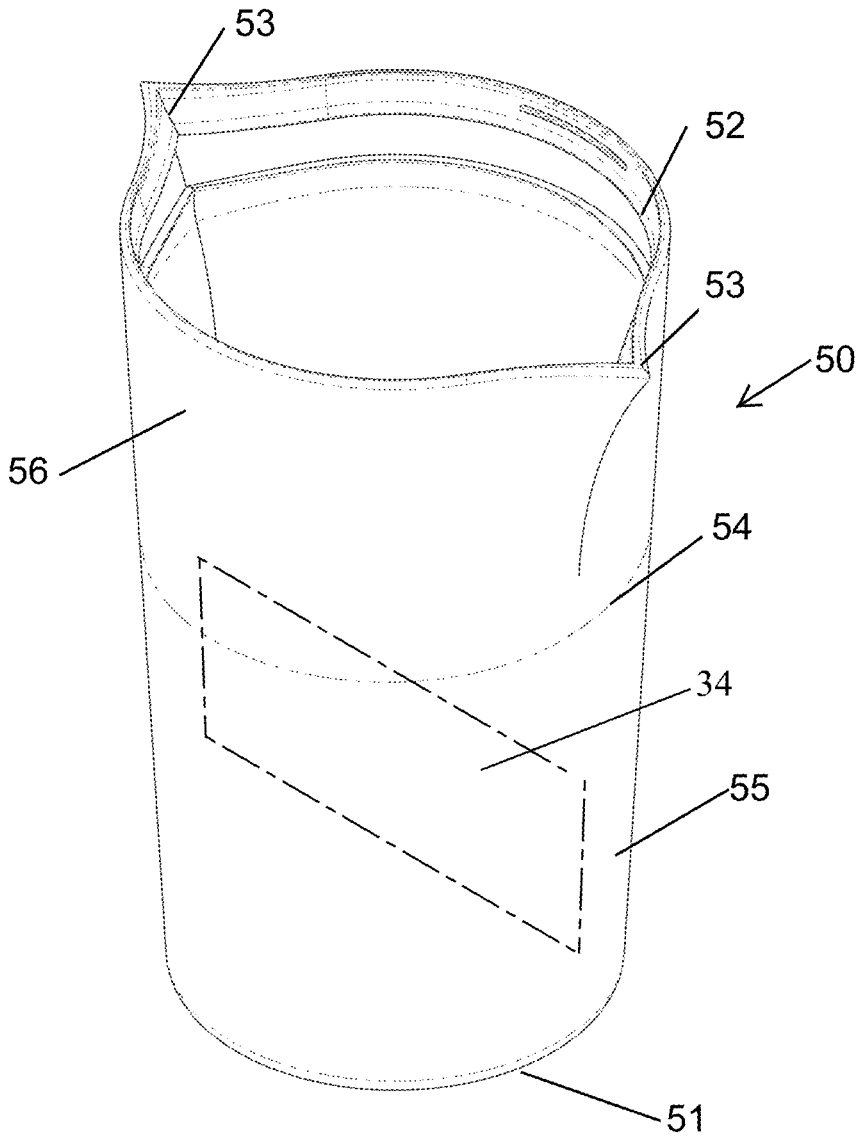
FIG. 3 shows a perspective view of a tumbler-shaped ice-making container in an open configuration and having a divider that is suspended between the sides.

FIG. 3 shows a perspective view of a tumbler-shaped ice-making container 50. The tumbler-shaped ice-making container 50 comprises a base 51 that is circular in shape. The tumbler-shaped ice-making container 50 further comprises a mouth 52 at the top, wherein the mouth 52 is generally circular when open and generally linear when closed. The tumbler-shaped ice-making container 50 further comprises a rim 54 between the base 51 and the mouth 52. The tumbler-shaped ice-making container 50 comprises a lower wall 55 between the base 51 and the rim 54 having a thickness and material composition that has sufficient stiffness or rigidity to freely stand vertically on its base 51. Further, the tumbler-shaped ice-making container 50 has an upper wall 56 between the base 51 and the rim 54 having a wall thickness and material composition sufficiently flexible or pliable to allow the mouth 52 to be deformed between open and closed configurations. In one embodiment, the circumference of the upper wall 56 above the rim 54 may be larger than the circumference of the lower wall 55 below the rim 54, so that the upper wall 56 may be rolled or folded down over the exterior of the lower wall 55 below the rim 54. In a rolled or folded down configuration, the container 50 may more fully function as a traditional bowl. To seal the tumbler-shaped ice-making container 50, the upper wall 56 may be unrolled or unfolded to an extended position, as shown in FIG. 3, and a zipper in the zipper slot 53 may be zipped to form a seal.

A divider 34 extends as a single-walled web from one side of the lower wall 55 to the other side of the lower wall 55, but does not connect with or touch the base 51. The divider 34 separates the lower portion of the container into two ice-making compartments. The divider 34 does not touch the base so that fluid may flow under the divider between the compartments. The space between the base 51 and the divider 34 is a fluid conduit large enough to allow fluid flow, but small enough to allow solid ice to be easily broken between the two compartments. While only one divider is shown in FIG. 3, any number of dividers may extend from the sides of the lower wall 55 and/or from other dividers to separate the space into ice-making compartments. In still other embodiments, the divider does not extend from one side of the lower wall 55 all the way to the other side of the lower wall 55, but rather it only protrudes from one side of the lower wall so as to extend into the liquid so that solidified ice will have a structural weakness at the divider along which the ice may be easily broken into smaller fragments by deformation of the lower wall 55. In these embodiments, the divider does not completely separate the compartments. According to certain embodiments, the divider merely extends from a wall or base into the interior of the container less than half way across the container so that compartments are defined on opposites sides of the container and are completely undivided near the center of the container. Any number of dividers may extend from the side toward the center without touching each other in the center, and compartments are still defined between the dividers.

According to one aspect of the invention, liquid may be inserted into the container to fill the lower wall up to about the top of the divider. The container may be closed by zipping the zipper members to close the mouth. The container may then be placed in a freezer or other below freezing environment until the liquid is solidified into ice. The container may be removed from the freezer environment. With the mouth still closed by the zipper members, crushing forces may be applied to the exterior of the container to break ice-cubes out of the compartments in the lower portion of the container.

Figure 4:
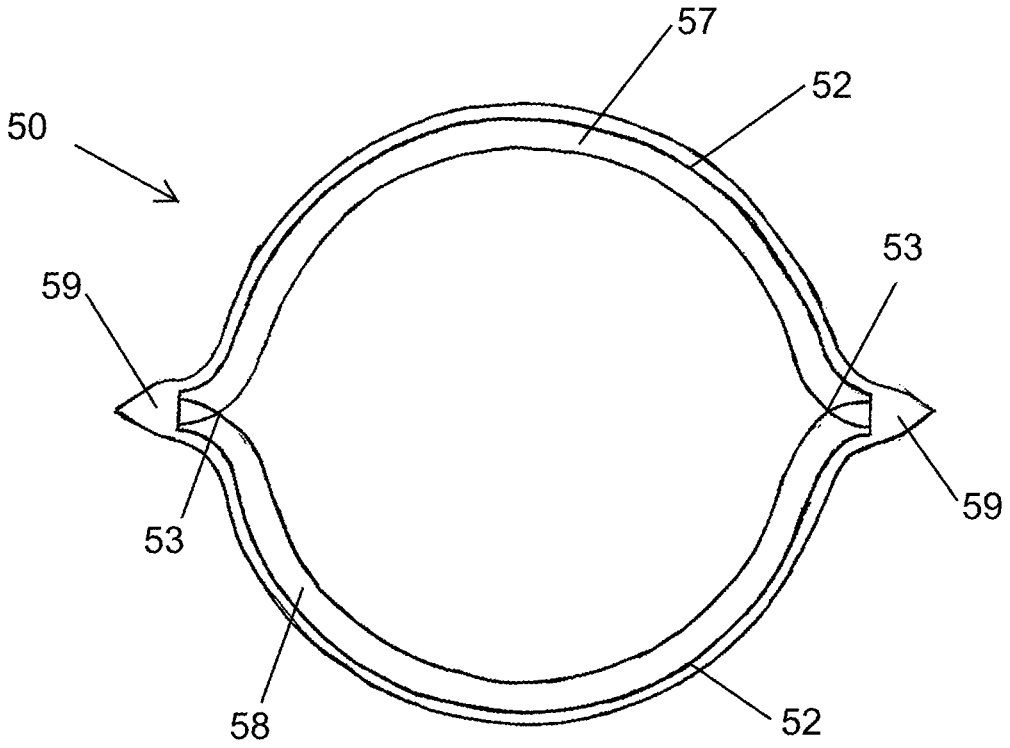
FIG. 4 shows a top view of the tumbler-shaped ice-making container of FIG. 3, wherein the zipper members cross over and remain engaged at the spouts.

FIG. 4 is a cross-sectional top view of the ice-making container of FIG. 3 having a circular mouth, wherein male and female zipper members 57 and 58 are shown. The male zipper member 57 is positioned just inside the mouth 52 and extends from one interior side of the ice-making tumbler-shaped ice-making container 50. The female zipper member 58 is positioned just inside the mouth 52 and extends from the other side of the ice-making tumbler-shaped ice-making container 50. In this embodiment, the ice-making tumbler-shaped ice-making container 50 has relatively thick tips 59 at opposite ends of the mouth 52, wherein each tip 59 forms an interior wall transverse to the axis of the mouth 52. The exterior surfaces of tips 59 provide "handles" for a user to hold the ice-making tumbler-shaped ice-making container 50 while closing the zipper members 57 and 58 together. The zipper members terminate at the interior walls of the tips 59 to completely seal the mouth 52 of the ice-making tumbler-shaped ice-making container 50 when closed. The zipper members 57 and 58 "cross over" each other at the tips 59 so that the male and female zipper elements completely engage at the tips 59, even when the mouth 52 of the ice-making tumbler-shaped ice-making container 50 is open as shown in FIG. 3. To close the mouth 52, a user simply squeezes the sides of the mouth 52 together and pinches the zipper members 57 and 58 together until the male and female zipper members 57 and 58 are completely engaged from tip 59 to tip 59. When open, the mouth 52 forms a spout 53 at each tip 59

Figure 5:
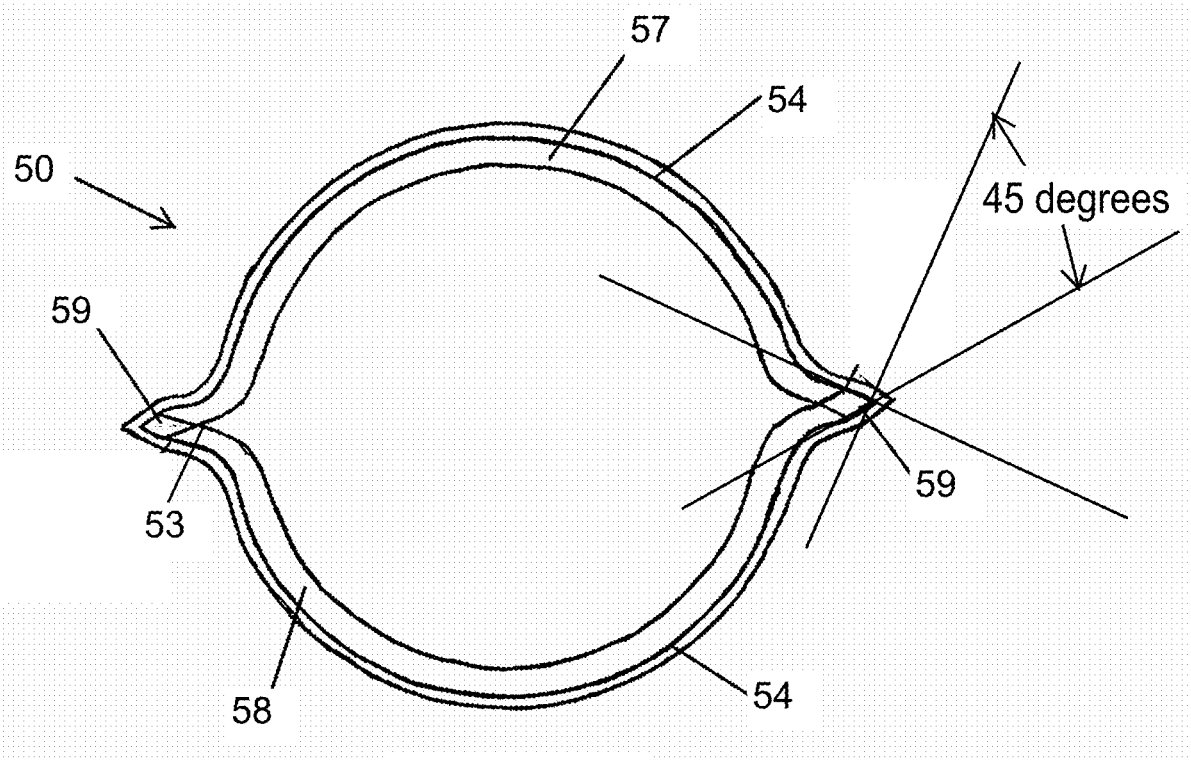
FIG. 5 shows a top view of the tumbler-shaped ice-making container of FIG. 3, wherein the zipper members cross over and remain engaged at the spouts.

FIG. 5 is a cross-sectional top view of an alternative ice-making tumbler-shaped ice-making container 50 having a circular mouth, similar to that of FIG. 3, wherein male and female zipper members 57 and 58 are shown. Similar to the embodiment shown in FIG. 4, the male zipper member 57 is positioned just inside the mouth 52 and extends from one interior side of the ice-making tumbler-shaped ice-making container 50 and the female zipper member 58 is positioned just inside the mouth 52 and extends from the other side of the ice-making tumbler-shaped ice-making container 50. However, in this embodiment, the tips 59, formed at each end of the mouth 52, have relatively thin wall thicknesses and each tip 59 does not form an interior wall transverse to the axis of the mouth 52. The wall thicknesses in the region of the tip 59 is approximately the same as the side walls forming the mouth 52. The male and female zipper members 57 and 58 extend all the way to the most extreme ends of the tips 59 and "cross over" each other at the tips 59. The ends of the zipper members 57 and 58 are angled at about 45 degrees, so that when the zipper members 57 and 58 are closed together, they seal the zipper at the tips 59.

FIGS. 6A-6E show perspective, top and cross-sectional end views of an ice-making container 60. The ice-making container 60 comprises a base 61 that is generally circular in shape. The ice-making container 60 further comprises a mouth 62 at the top, wherein the mouth is generally circular when open and generally linear when closed. At each end of the interior of the mouth 62, the ice-making container 60 has a spout 63. In this embodiment, the tips 69, formed at each end of the mouth 62, have wall thicknesses approximately the same as the side walls forming the mouth 62. The male zipper member 67 is positioned just inside the mouth 62 and protrudes from one interior side of the ice-making container 60 and extends from one spout 63 to the other spout 63. The female zipper member 68 is positioned just inside the mouth 62 and protrudes from the other interior side of the ice-making container 60 and extends from one spout 63 to the other spout 63. In this embodiment, the dividers 64 are dual-walled so as to define compartments 65 for ice-cubes that are smaller at the bottoms than at the tops. The walls 66 of the dividers join at the top and angle away from each other toward the bottom. With angled walls 66, the compartments 65 are wider at their tops and narrow in their bottoms, which enables ice-cubes to more easily pop out of the compartments 65. In alternative embodiments, the dividers may take any shape or configuration to facilitate the making of ice-cubes.

Figure 6A:
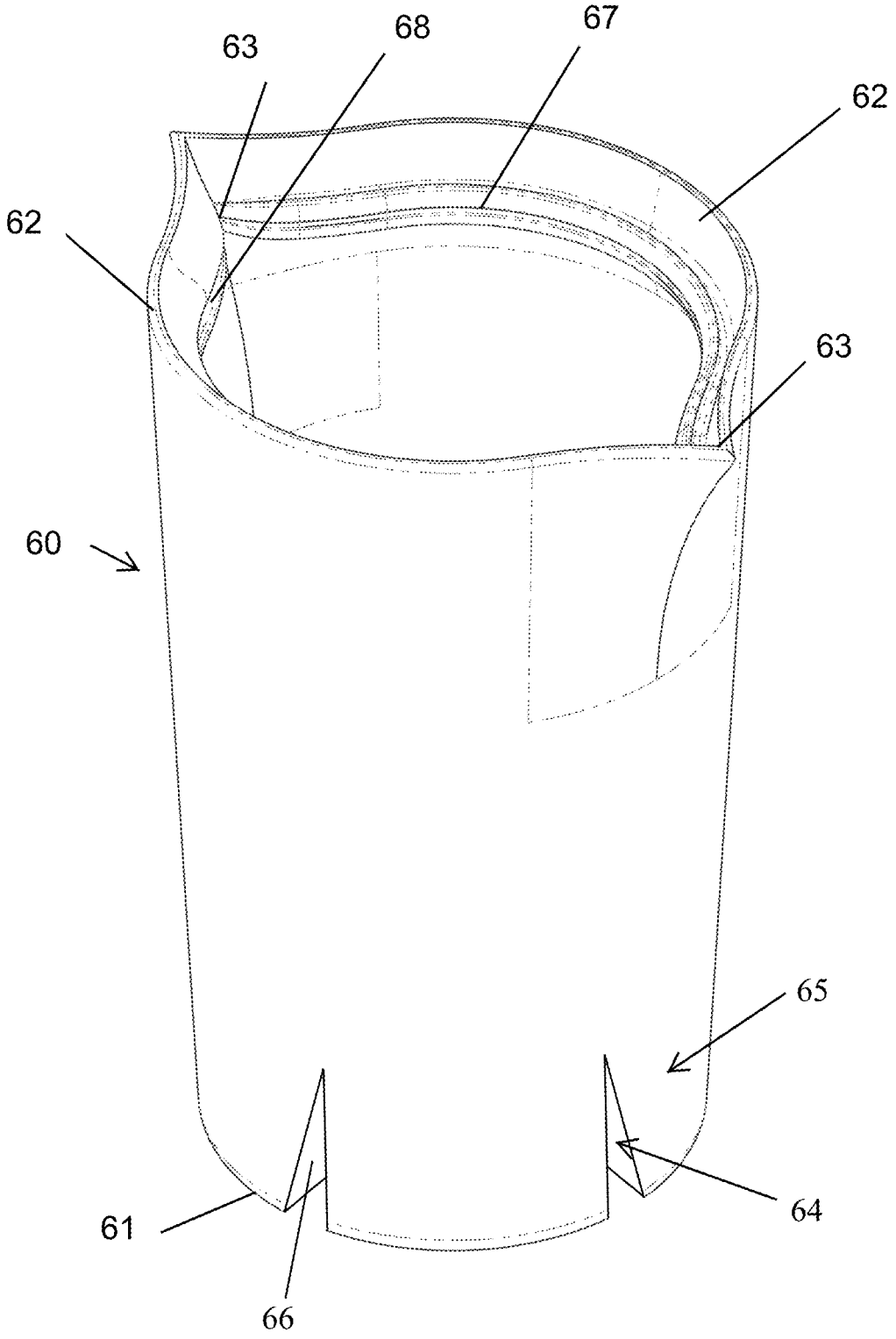
FIG. 6A is a perspective view of a tumbler-shaped ice-making container having a spout at each end of the mouth and dividers in the bottom of the container.
Figure 6B:
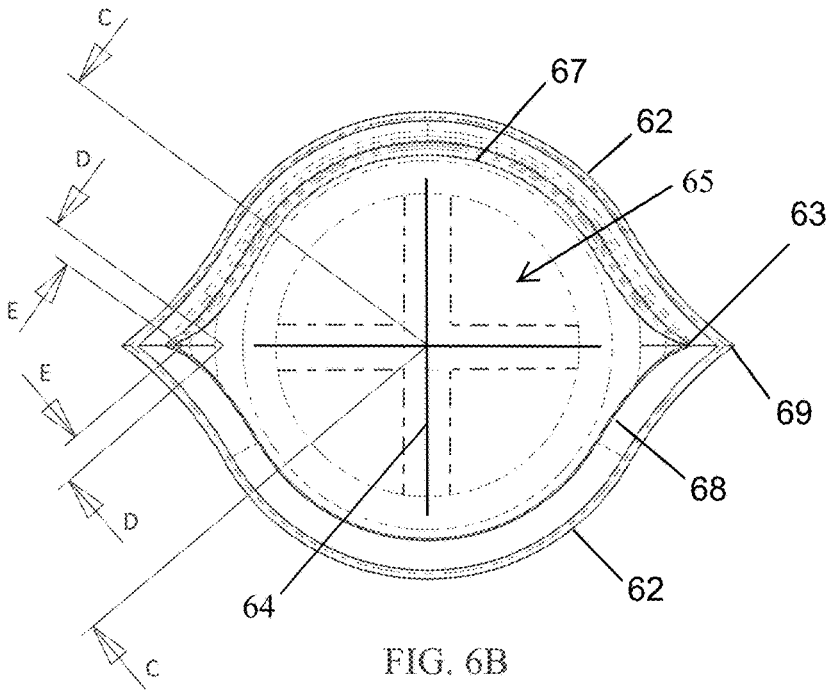
FIG. 6B shows a top view of the tumbler of FIG. 6A with cross-sections indicated.

FIG. 6B is a top view of the ice-making container 60 in an open configuration, wherein dividers defining compartments for making ice cubes are visible. In this embodiment, the cup-shaped ice-making container 60 has four compartments 65 for making ice-cubes separated by dividers 64. In alternative embodiments, any number of compartments may be used. The compartments 65 are generally triangular in shape. In alternative embodiments, the compartments may take any shape or configuration to facilitate the making of ice-cubes.

Figure 6C:
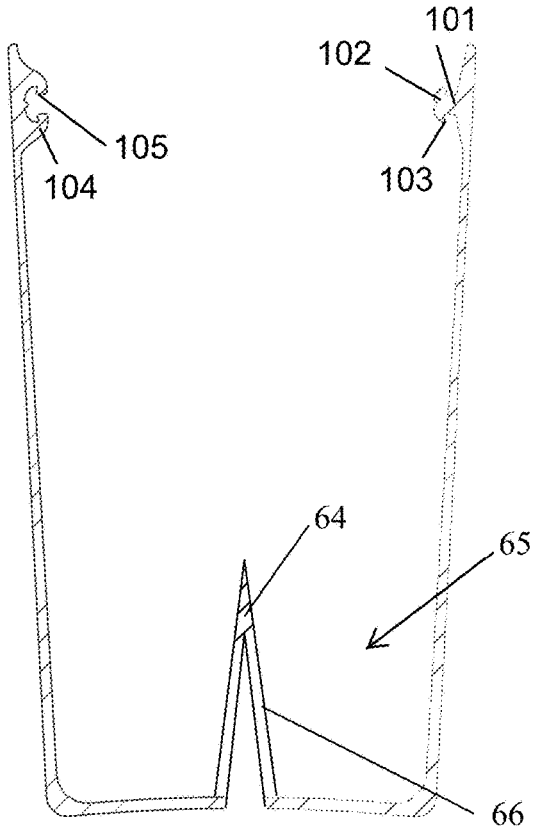
FIGS. 6C, 6D and 6E are cross-sectional end views of the indicated cross-sections of FIG. 6B.
Figure 6D:
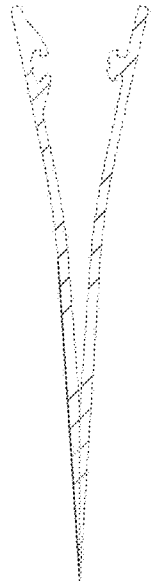
Figure 6E:
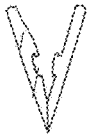

FIG. 6B indicates cross-sections, wherein sections C-C, D-D and E-E are shown in FIGS. 6C-6E, respectively. Throughout a substantial portion of the middle of the male and female members 67 and 68, the members are fully formed and fully dimensioned. FIG. 6C shows the fully formed and fully dimensioned male and female members 67 and 68. In this embodiment, the members have interlocking features that hold them together and form a seal when the male zipper member 67 is inserted into the female zipper member 68. In cross-section, the male zipper member 67 has a button or mushroom profile having a trunk 101 with a head 102 at the distal end of the trunk 101. The head 102 is wider than the trunk 101 so that two shoulders 103 extend in opposite directions from the trunk 101. In cross-section, the female zipper member 68 comprises two opposed flanges 104, wherein each flange 104 has a shoulder 105 extending toward the opposite flange 104. When the male and female members 67 and 68 are engaged to close and seal the mouth 62, the head 102 is inserted between the flanges 104 until the shoulders 103 of the male zipper member 67 become locked behind shoulders 105 of the female zipper member 68. Because the male and female members 67 and 68 are made of a flexible material, the members flex during insertion and rebound upon engagement.

As the male and female members 67 and 68 extend toward the spouts 63, they become shorter in height but retain their form. FIG. 6D shows the relatively shorter male and female members 67 and 68. In particular, the size of the head 102 of the male zipper member 67 is the same size and the channel defined by the flanges 104 of the female zipper member 68 is the same size as the head and channel shown in FIG. 6C.

FIG. 6C is a cross-sectional side view of the cup-shaped ice-making container 60 in an open configuration. The divider 64 is shown in cross-section comprising two walls 66 that join together at the top. The compartments 65 are defined by the divider 64 and the exterior walls of the ice-making container 60.

As the male and female members 67 and 68 extend nearly to the spouts 63, they become even shorter in height and change their form. In this embodiment, the members change their form by reducing the size of the head 102 and reducing the size of the channel between the flanges 104. FIG. 6E shows the relatively shorter male and female members 67 and 68. The shoulders 103 and 105 also shrink in size as the member tapers toward the spouts 63. The male and female members 67 and 68 continue to taper until they become non-existent at the spouts 63.

Figure 6F:
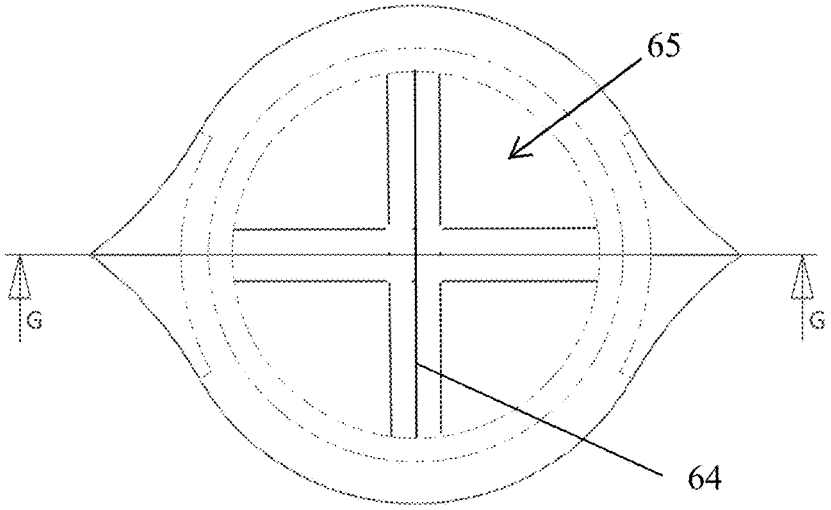
FIG. 6F shows a top view of the tumbler-shaped ice-making container of FIG. 6A with a cross-section indicated.
Figure 6G:
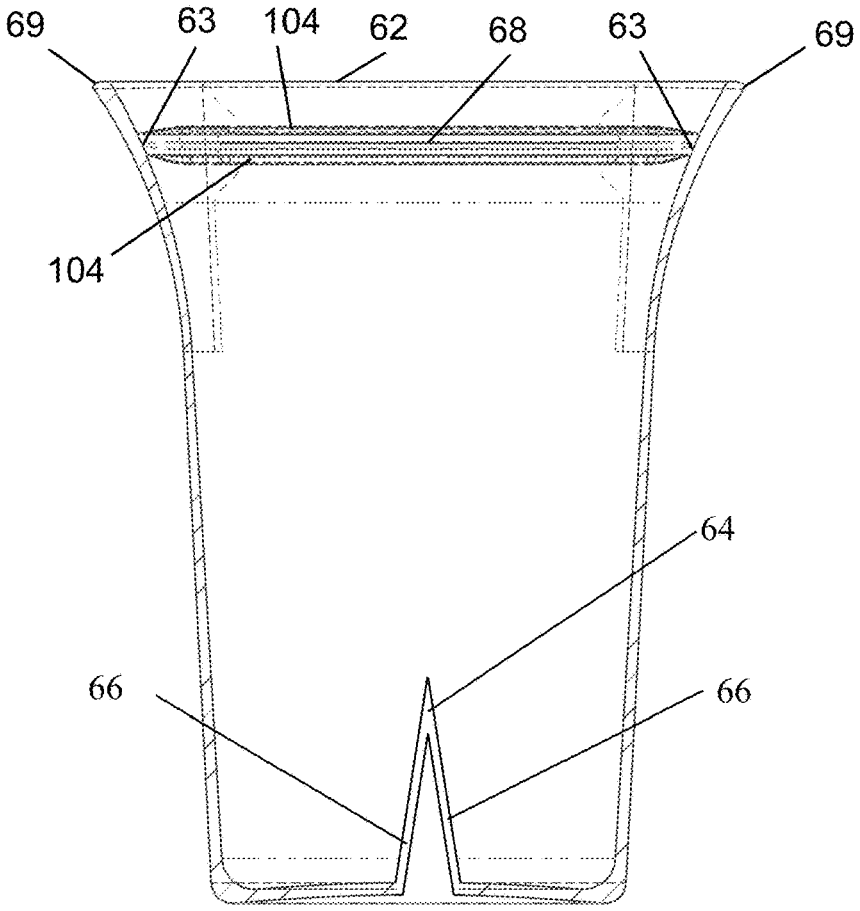
FIG. 6G is a cross-sectional front view of the tumbler-shaped ice-making container of FIG. 6A showing how the zipper member terminates at the spouts.

FIG. 6F is a bottom view of the ice-making container 60 shown in FIGS. 6A-6E, indicating a cut-away elevation G-G along the axis of the mouth 62. The four separate compartments 65 are defined by the dividers 64 and the exterior walls of the ice-making container 60. FIG. 6G is a cut-away front view of the ice-making container 60, wherein the cut-away is at Section G-G so that the interior of the ice-making container 60 is visible. The female zipper member 68 extends from one spout 63 to the other. The female zipper member 68 has two flanges 104, which define a channel between for receiving the head 102 of the male zipper member 67 (not shown). The flanges 104 taper and become smaller as they extend toward the spouts 63 so that they terminate at the spouts 63. Of course, the channel defined between the flanges 104 also terminates at the spouts 63. The divider 64 is shown in cross-section comprising two walls 66 that join together at the top. The compartments 65 are defined by the divider 64 and the exterior walls of the ice-making container 60.

Referring again to FIGS. 6A and 6B, the male and female zipper members 67 and 68 do not interfere with the spout 63. When the mouth 62 is open, the male and female zipper members 67 and 68 do not engage with each other at the spouts 63. This allows a fluid contained within the ice-making container 60 to be poured out of either spout 63 without flowing over either of the male and female zipper members 67 and 68. Rather, the fluid may flow between the male and female zipper members 67 and 68 through either of the spouts 63. Further, because the zipper members do not engage when the mouth 62 is open, there is less opportunity for debris and residue to become lodged in the channel defined between the flanges 104 of the female zipper member 68 or behind the head 102 of the male zipper member 67.

FIGS. 7A-7D show perspective cross-sectional end views of an alternative ice-making tumbler 70. The tumbler 70 comprises a base 71 that is generally circular in shape. The tumbler 70 further comprises a mouth 72 at the top, wherein the mouth is generally circular when open and generally linear when closed. At each end of the interior of the mouth 72, the tumbler 70 has a spout 73. In this embodiment, the tips 79, formed at each end of the mouth 72, have wall thicknesses approximately the same as the side walls forming the mouth 72. The male zipper member 77 is positioned just inside the mouth 72 and protrudes from one interior side of the tumbler 70 and extends from one spout 73 to the other spout 73. The female zipper member 78 is positioned just inside the mouth 72 and protrudes from the other interior side of the tumbler 70 and extends from one spout 73 to the other spout 73. In this embodiment, the male and female zipper members 77 and 78 have end sections near the spouts 73 that are much different than the middle sections.

Figure 7A:
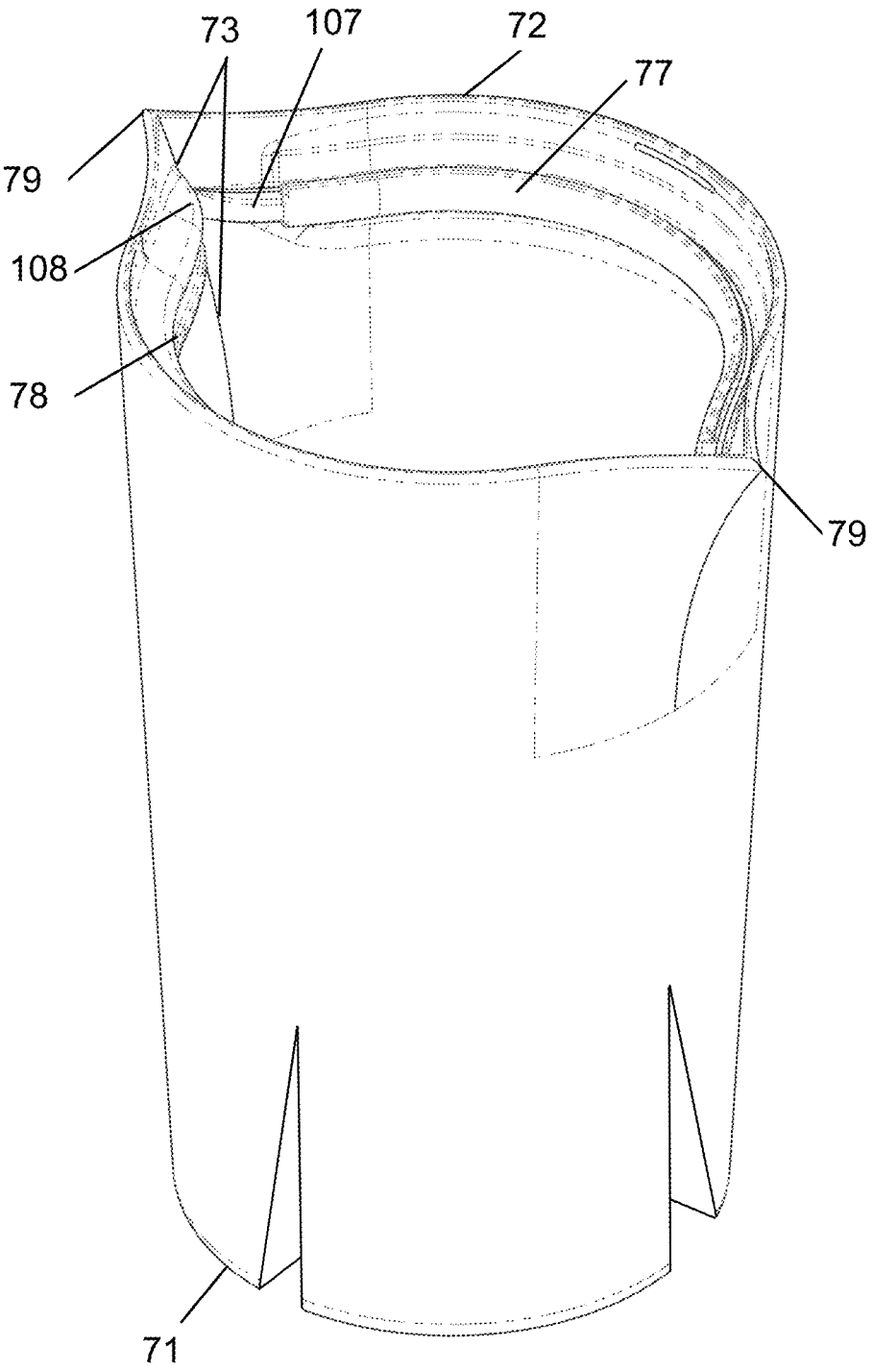
FIG. 7A is a perspective view of a tumbler-shaped ice-making container having a spout at each end of the mouth and an alternative embodiment of the zipper members.
Figure 7B:
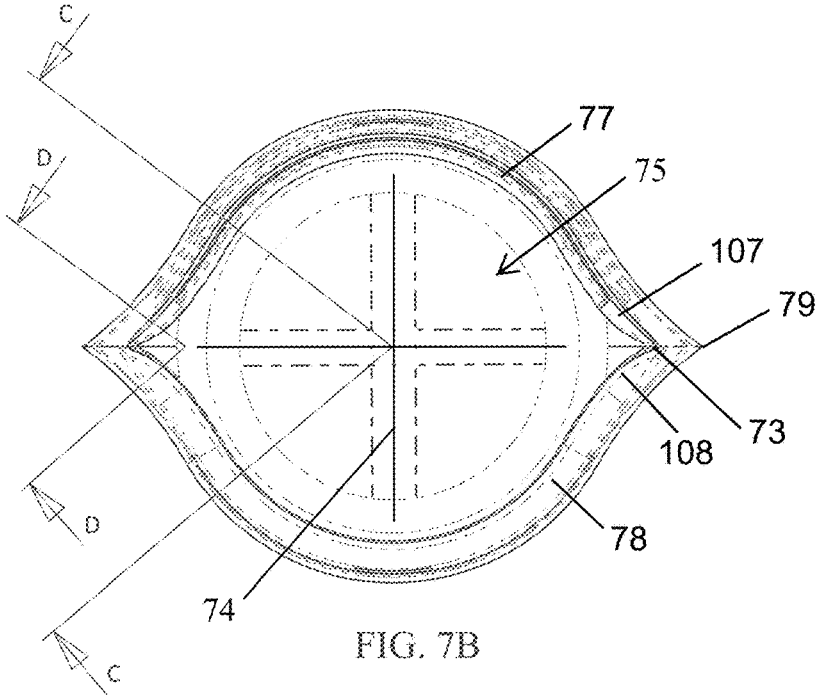
FIG. 7B shows a top view of the tumbler-shaped ice-making container of FIG. 7A with cross-sections indicated.
Figure 7C:
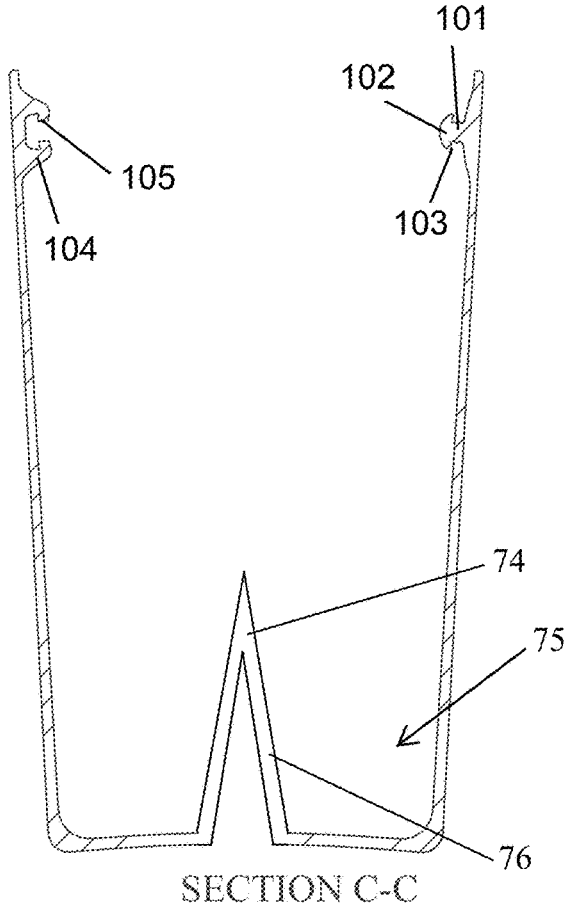
FIGS. 7C and 7D are cross-sectional end views of the indicated cross-sections of FIG. 7B.
Figure 7D:
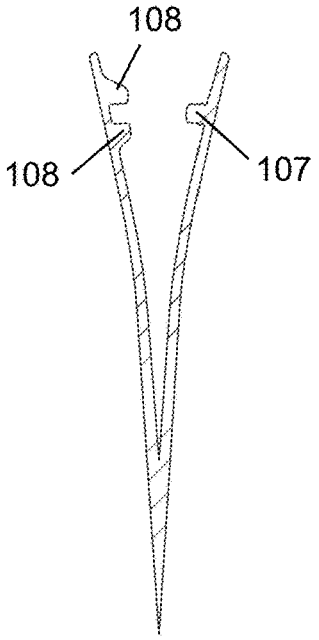

FIG. 7A is a perspective view of the ice-making tumbler 70. FIG. 7B is a top view of the tumbler 70 with indicated cross-sections, wherein sections C-C and D-D are shown in FIGS. 7C and 7D, respectively. FIG. 7C shows the male zipper member 77 has a button or mushroom profile having a trunk 101 with a head 102 at the distal end of the trunk 101. The head 102 is wider than the trunk 101 so that two shoulders 103 extend in opposite directions from the trunk 101. In cross-section, the female zipper member 78 comprises two opposed flanges 104, wherein each flange 104 has a shoulder 105 extending toward the opposite flange 104. When the male and female members 77 and 78 are engaged to close and seal the mouth 72, the head 102 is inserted between the flanges 104 until the shoulders 103 of the male zipper member 77 become locked behind shoulders 105 of the female zipper member 78. Both the male zipper member 77 and female zipper member 78 maintain their cross-sectional profiles throughout the entire middle sections. The ends of the male and female zipper members 77 and 78 have a different profile compared to the middle sections. The ends of the male zipper members 77 have a cross-sectional profile in the shape of a headless trunk 107. See FIG. 7D. The ends of the female zipper members 78 have a cross-sectional profile in the shape of two shoulderless flanges 108, which define a channel between the flanges. See FIG. 7D. Thus, a difference between the embodiment of FIGS. 6A-6F and the embodiment of FIGS. 7A-7D is that the shoulders 103 and 105 terminate well before the male and female zipper members 77 and 78 terminate at the spouts 73. However, a similar feature of the two embodiments is that the male and female zipper members 77 and 78 do not interfere with the spout 73. When the mouth 72 is open, the male and female zipper members 77 and 78 do not engage with each other at the spouts 73. This allows a fluid contained within the tumbler 70 to be poured out of either spout 73 without flowing over either of the male and female zipper members 77 and 78. Rather, the fluid may flow between the headless trunk 107 and the shoulderless flanges 108 through either of the spouts 73. Further, because the zipper members do not engage when the mouth 72 is open, there is less opportunity for debris and residue to become lodged in the channel defined between the shoulderless flanges 108 of the female zipper member 78 or around the headless trunk 107 of the male zipper member 77.

FIG. 7C is a cross-sectional side view of the ice-making container in an open configuration. In the mouth 72 of the container 70, there is a male zipper member 77 and a female zipper member 78. The divider 74 is shown in cross-section comprising two walls 76 that join together at the top. The compartments 75 are defined by the divider 74 and the exterior walls of the ice-making container 70.

FIGS. 8A-8F show perspective, end, side, top and bottom views of an alternative ice-making container 80. The ice-making container 80 comprises a base 81 that is generally an elongated hexagon in shape. The ice-making container 80 further comprises a freestanding side 86 extending from the base 81 to form a mouth 82 at the top, wherein the mouth is generally an elongated hexagon in shape when open and generally linear when closed. At each end of the interior of the mouth 82, the ice-making container 80 has a spout 83. In this embodiment, the tips 89, formed at each end of the mouth 82, have wall thicknesses approximately the same as the side walls forming the mouth 82. The male zipper member 87 is positioned just inside the mouth 82 and protrudes from one interior side of the ice-making container 80 and extends from one spout 83 to the other spout 83. The female zipper member 88 is positioned just inside the mouth 82 and protrudes from the other interior side of the ice-making container 80 and extends from one spout 83 to the other spout 83. In this embodiment, the male and female zipper members 87 and 88 have end sections near the spouts 83 that are much different than the middle sections. In particular, the zipper members reduce in size and shape until they terminate at the spouts 83.

Figure 8A:
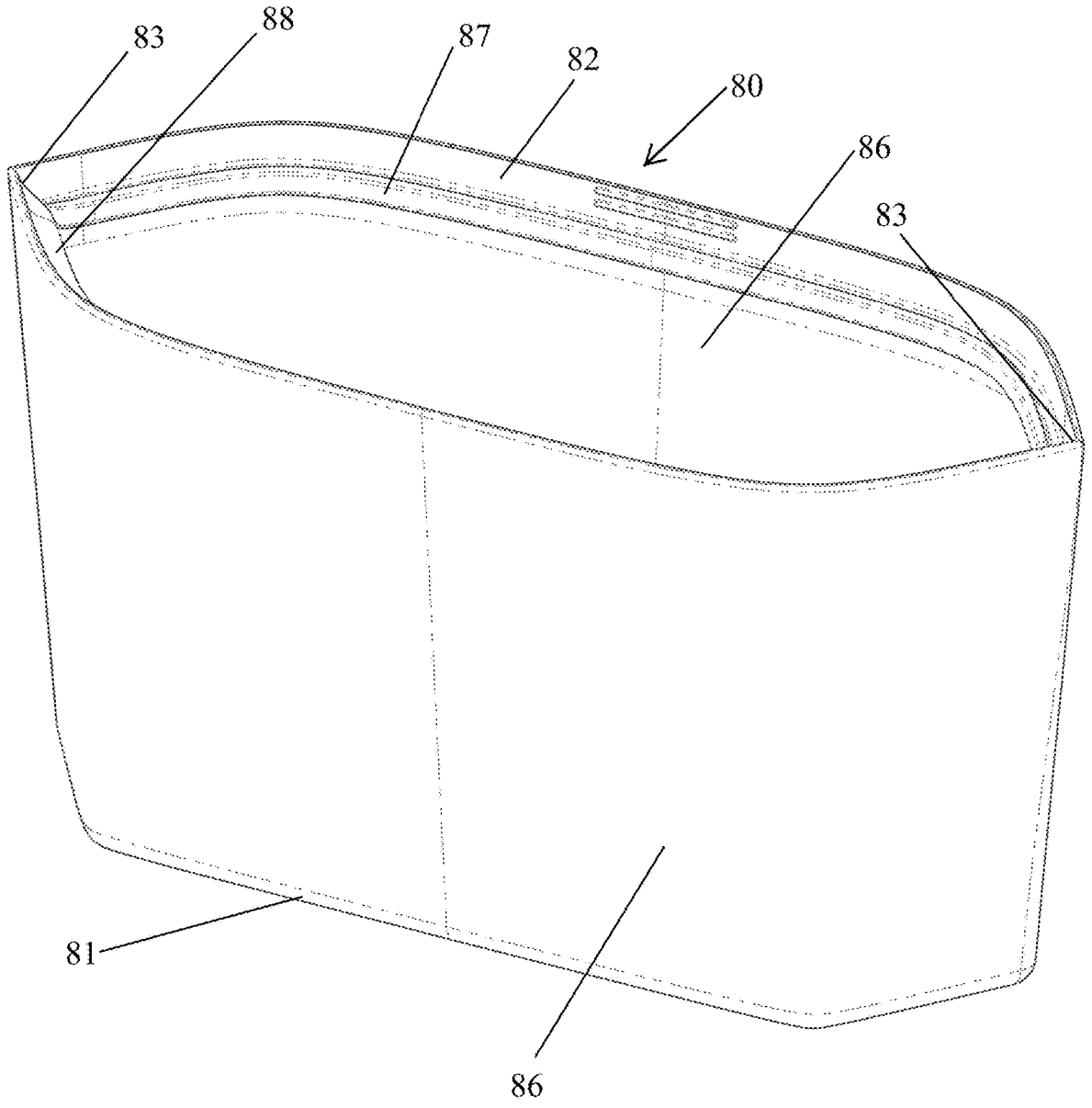
FIG. 8A is a perspective top view of an elongated hexagon shaped ice-making container having a spout at each end of a mouth.
Figure 8B:
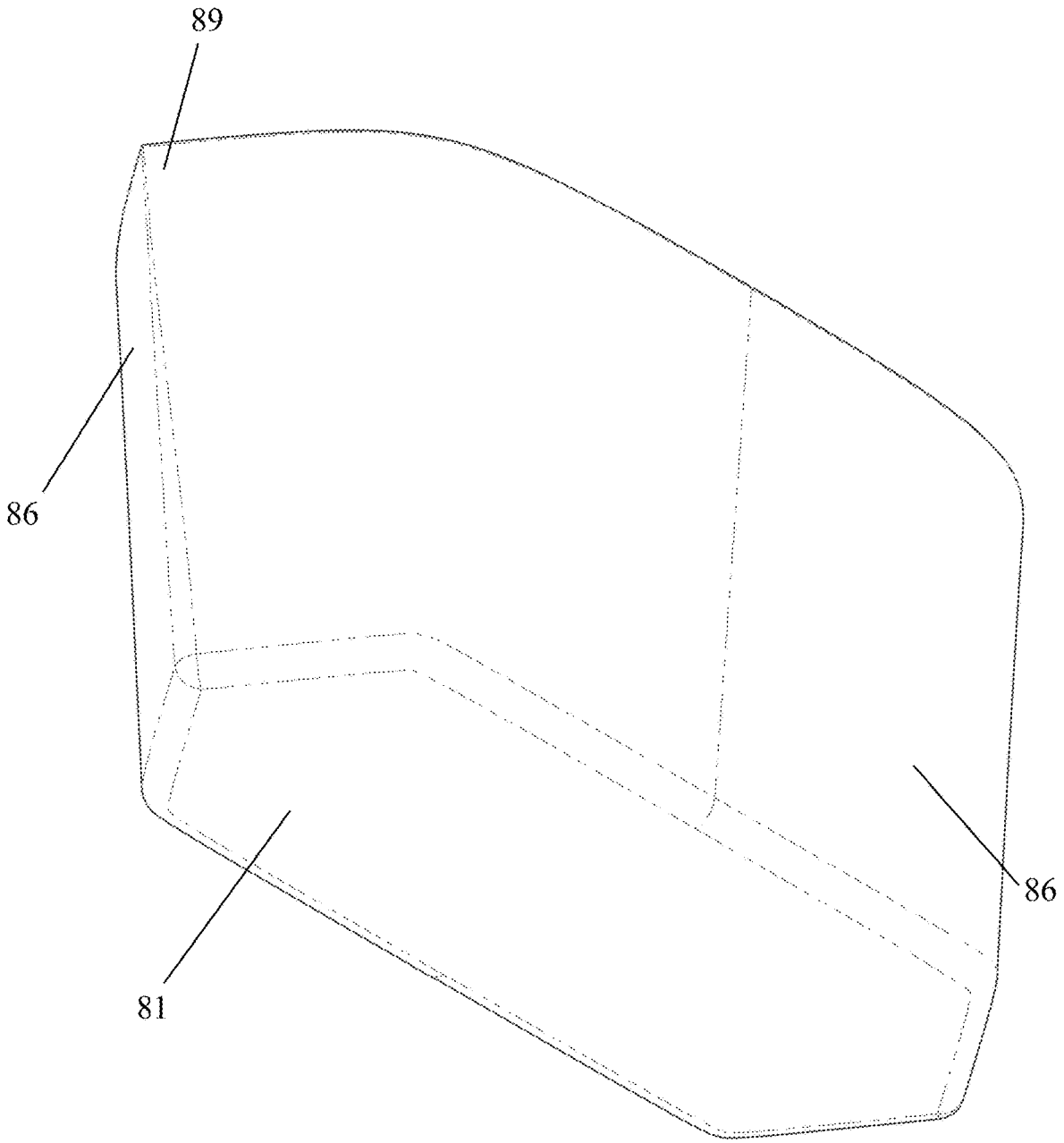
FIG. 8B shows a perspective bottom view of the elongated hexagon shaped ice-making container of FIG. 8A with a base and freestanding side.
Figure 8C:
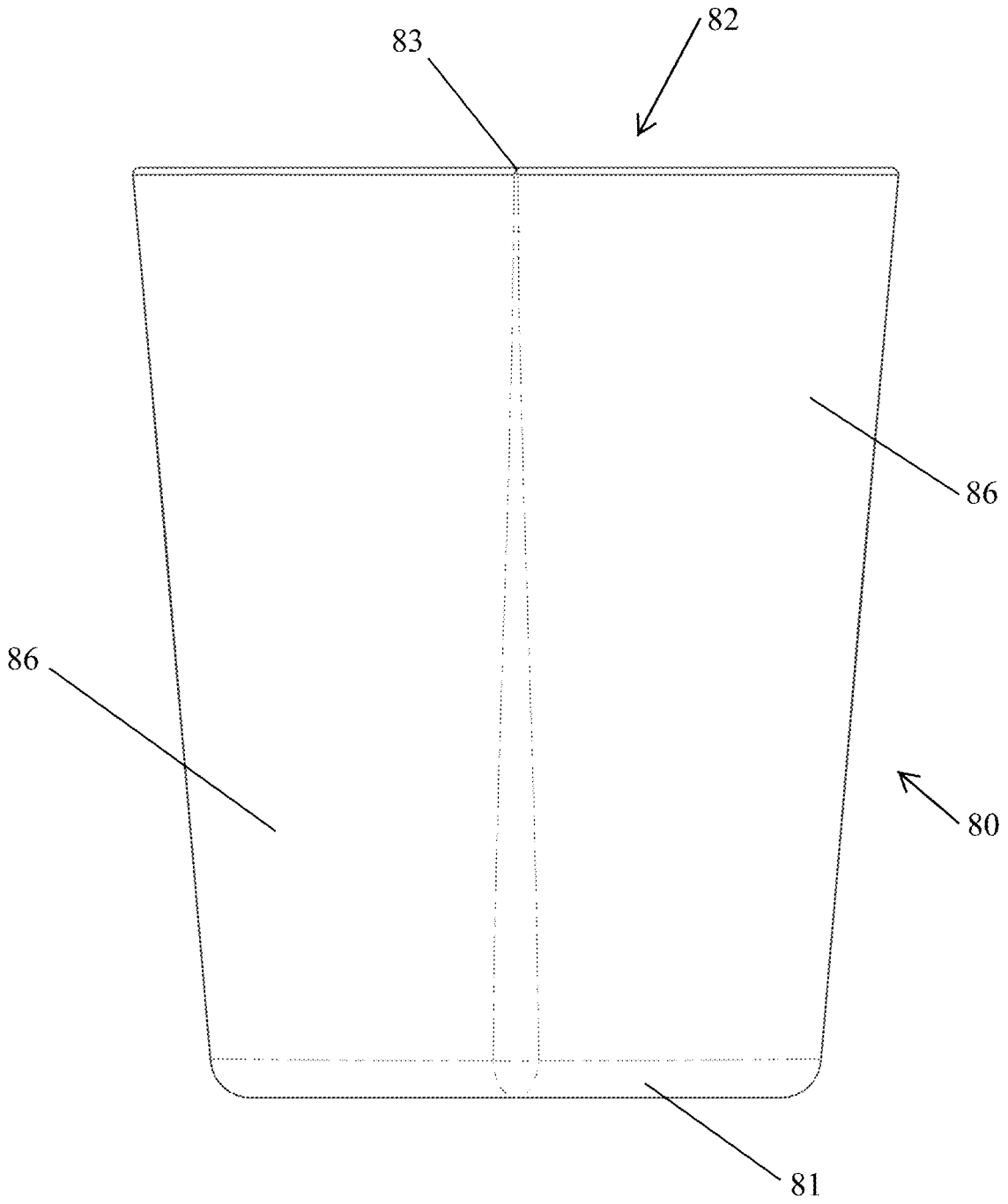
FIG. 8C shows an end view of the elongated hexagon shaped ice-making container of FIGS. 8A-8B.
Figure 8D:
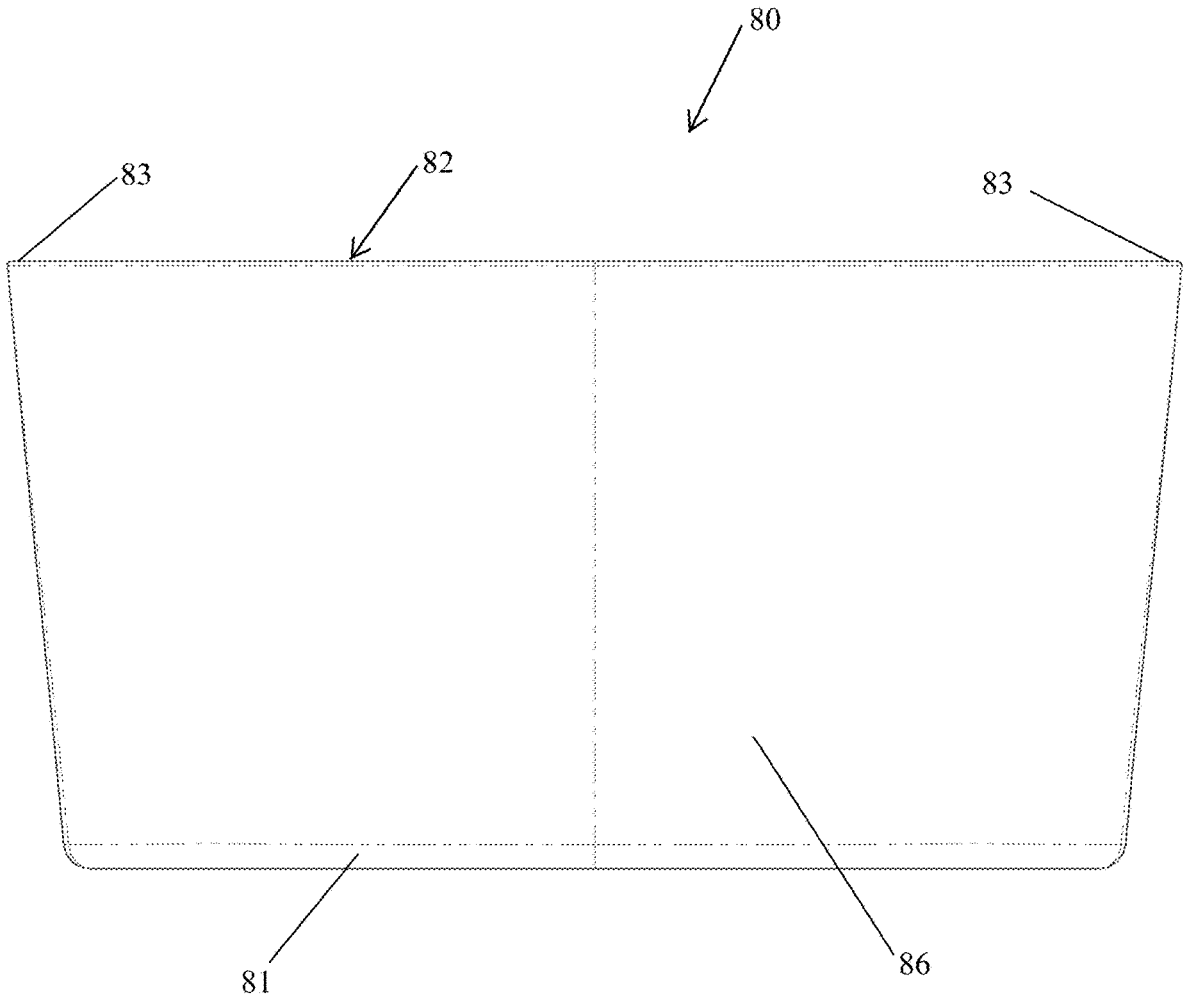
FIG. 8D shows a side view of the elongated hexagon shaped ice-making container of FIGS. 8A-8C.
Figure 8E:
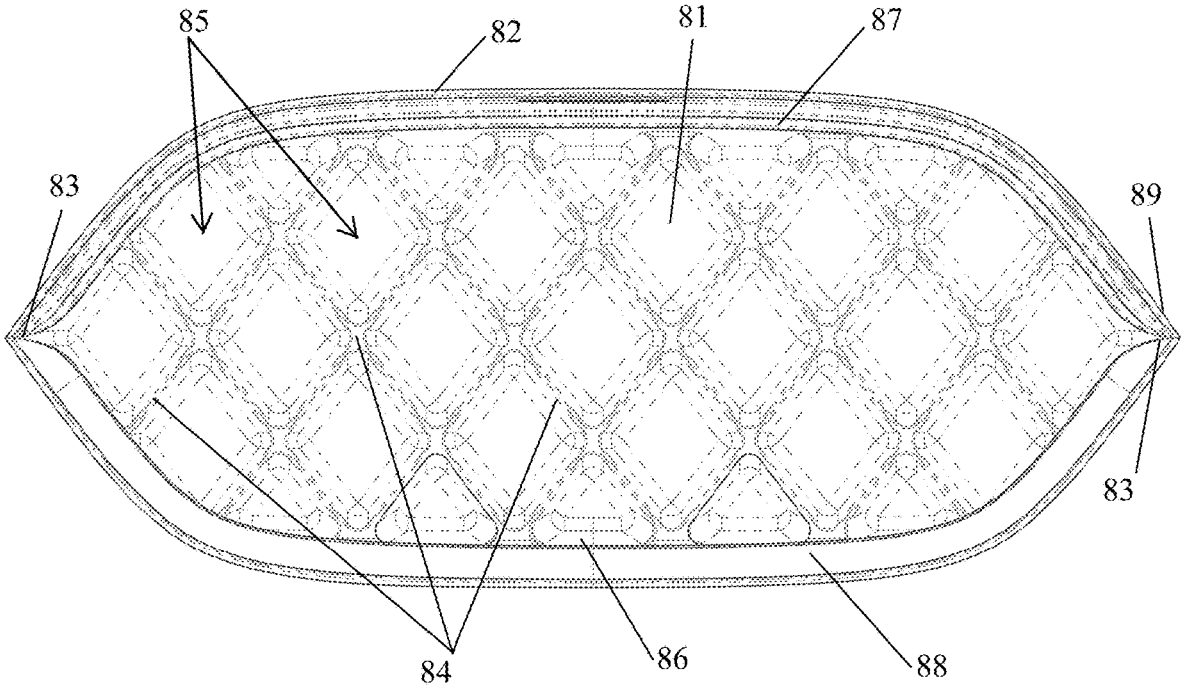
FIG. 8E shows a top view of the elongated hexagon shaped ice-making container of FIGS. 8A-8D, wherein ice-making compartments are visible in the bottom of the container defined by the base, dividers, and the freestanding side.
Figure 8F:
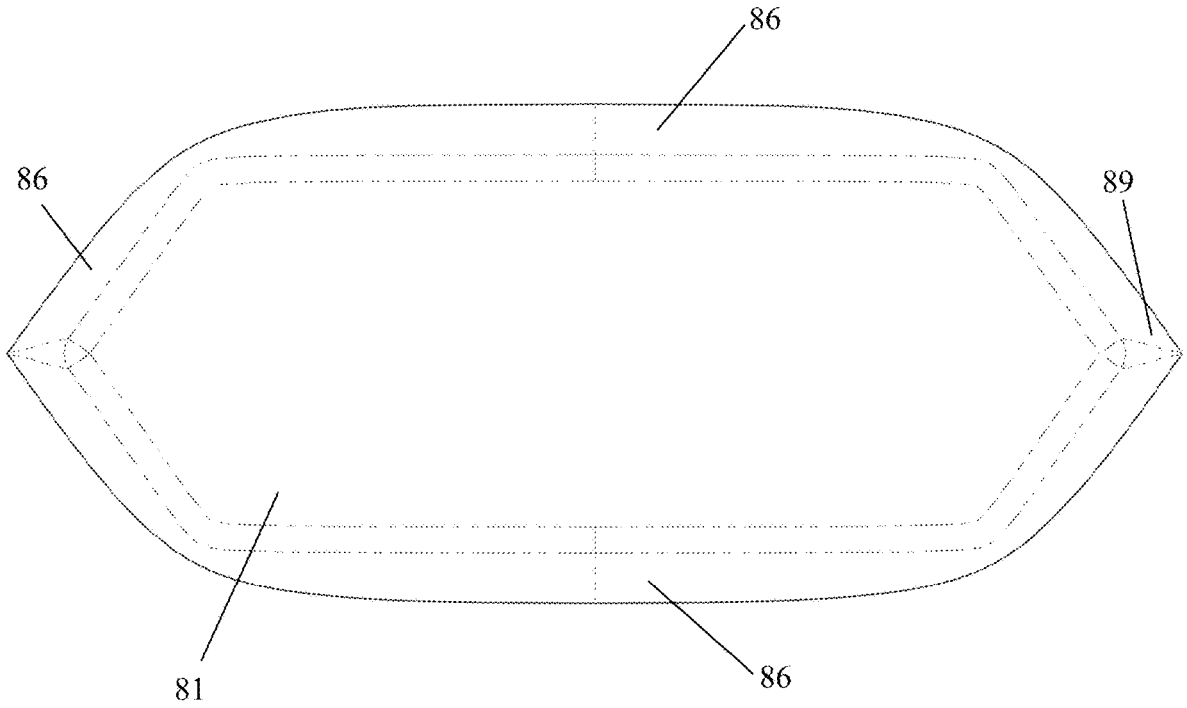
FIG. 8F shows a bottom view of the elongated hexagon shaped ice-making container of FIGS. 8A-8E.

FIG. 8E illustrates a top view of the ice-making container 80. Dividers 84 extend up from the base 81 to define compartments 85. In this embodiment, the compartments 85 are rhombus and triangular in shape, wherein the interior compartments 85 are rhombus and the perimeter compartments 85 are triangular. Each interior compartment 85 is defined by a portion of the base 81 at its bottom and dividers 84 at its sides. Each perimeter compartment 85 is defined by a portion of the base 81, dividers 84 at a portion of its sides, and a portion of the freestanding side 86 at the remainder of its side. The dividers 84 are single-walls having wall thicknesses that are thicker at the bottoms toward the base 81 and thinner toward the tops, so that the width dimensions of the compartments 85 are narrow near the bottoms and wide near the tops. A fluted compartment shape may facilitate freeing ice cubes from the compartments when compression forces are applied to the exterior of the container 80.

Although the disclosed embodiments are described in detail in the present disclosure, it should be understood that various changes, substitutions and alterations can be made to the embodiments without departing from their spirit and scope.

What is claimed is:

1. An ice-making container comprising:

a base and a freestanding side extending from the base to define a mouth opposite the base;

at least one divider extending from at least one of the base and the freestanding side so as to divide the ice-making container into at least two ice-making compartments;

a first zipper member extending from a first interior portion of the mouth;

a second zipper member extending from a second interior portion of the mouth, wherein the mouth is deformable between open and closed configurations and the first and second zipper members are disengagable when the mouth is open and engagable when the mouth is closed, wherein the base, the freestanding side, the at least one divider, and the first and second zipper members are a unitary whole ice-making container without assembled parts, wherein the mouth has two spouts at opposite ends of the mouth, where the spouts are between opposite ends of the first and second zipper members, wherein the first and second zipper members do not extend across the spouts between the zipper members, wherein the first and second zipper members end at the two spouts, wherein both of the first and second zipper members each have a middle and opposite ends and both of the first and second zipper member have cross-sectional profiles at the middle that are larger than cross-sectional profiles toward the opposite ends.

2. An ice-making container, as claimed in claim 1, wherein the at least one divider comprises two walls that join at a distal end of the divider and angle away from each toward proximal end of the divider where the wall extend from the base, wherein the base is divided by the divider and at least two compartments are more narrow closer to the base.

3. An ice-making container, as claimed in claim 1, wherein the at least one divider comprises a fluid communication conduit between the two compartments.

4. An ice-making container, as claimed in claim 1, wherein portions of the base, portions of the freestanding side, and portions of the at least one divider define the at least two ice-making compartments.

5. An ice-making container, as claimed in claim 1, wherein the container comprises silicone.

6. An ice-making container, as claimed in claim 1, wherein the first zipper member is male and the second zipper member is female, wherein the first and second zipper members seal the mouth when engaged.

7. An ice-making container, as claimed in claim 1, wherein a cross-sectional profile of the first zipper member comprises a head at a distal end of a trunk and the head has shoulders extending in opposite directions substantially transverse from a central axis of the trunk, wherein a cross-sectional profile of the second zipper member comprises two flanges defining a channel between the flanges and each flange has a shoulder at its distal end.

8. An ice-making container, as claimed in claim 1, wherein the base and sides have thicknesses greater than 0.5 mm.

9. An ice-making container made by a molding process, wherein the ice-making container comprises:

a base and a freestanding side extending from the base to define a mouth opposite the base;

at least one divider extending from at least one interior side selected from an interior side of the base and an interior side of the freestanding side so as to divide the container into at least two ice-making compartments;

a first zipper member extending from a first interior portion of the mouth;

a second zipper member extending from a second interior portion of the mouth, wherein the mouth is deformable between open and closed configurations and the first and second zipper members are disengagable when the mouth is open and engagable when the mouth is closed, wherein the base, the freestanding side, the at least one divider, and the first and second zipper members are a unitary whole container without assembled parts, wherein the molding process comprises a molding process selected from liquid injection molding, compression molding, and transfer molding, wherein the mouth has two spouts at opposite ends of the mouth, where the spouts are between opposite ends of the first and second zipper members, wherein the first and second zipper members do not extend across the spouts between the zipper members, wherein the first and second zipper members end at the two spouts, wherein both of the first and second zipper members each have a middle and opposite ends and both of the first and second zipper member have cross-sectional profiles at the middle that are larger than cross-sectional profiles toward the opposite ends.

10. An ice-making container made by a molding process as claimed in claim 9, wherein the molding process further comprises molding the first and second zipper members and overmolding the first and second zipper members while molding the container.

11. An ice-making container made by a molding process as claimed in claim 9, wherein the at least one divider comprises two walls that join at a distal end of the divider and angle away from each toward proximal end of the divider where the wall extend from the base, wherein the base is divided by the divider and at least two compartments are more narrow closer to the base.

12. An ice-making container made by a molding process as claimed in claim 9, wherein the at least one divider comprises a fluid communication conduit between the two compartments.

13. An ice-making container made by a molding process as claimed in claim 9, wherein portions of the base, portions of the freestanding side, and portions of the at least one divider define the at least two ice-making compartments.

14. An ice-making container made by a molding process as claimed in claim 9, wherein the container comprises silicone.

15. An ice-making container made by a molding process as claimed in claim 9, wherein the first zipper member is male and the second zipper member is female, wherein the first and second zipper members seal the mouth when engaged.

16. An ice-making container made by a molding process as claimed in claim 9, wherein a cross-sectional profile of the first zipper member comprises a head at a distal end of a trunk and the head has shoulders extending in opposite directions substantially transverse from a central axis of the trunk, wherein a cross-sectional profile of the second zipper member comprises two flanges defining a channel between the flanges and each flange has a shoulder at its distal end.

17. An ice-making container made by a molding process as claimed in claim 9, wherein the base and sides have thicknesses greater than 0.5 mm.

* * * * *